US012553165B2

(12) United States Patent
Feix et al.

(10) Patent No.: US 12,553,165 B2
(45) Date of Patent: Feb. 17, 2026

(54) ROTATIONAL WINDING APPARATUS AND METHOD

(71) Applicant: adidas AG, Herzogenaurach (DE)

(72) Inventors: Thomas Feix, Herzogenaurach (DE); Clemens Paul Dyckmans, Nuremberg (DE); Ian James Hennebery, Portland, OR (US)

(73) Assignee: adidas AG, Herzogenaurach (DE)

( * ) Notice: Subject to any disclaimer, the term of this patent is extended or adjusted under 35 U.S.C. 154(b) by 94 days.

(21) Appl. No.: 18/400,620

(22) Filed: Dec. 29, 2023

(65) Prior Publication Data

US 2025/0215627 A1 Jul. 3, 2025

(51) Int. Cl.
*D04H 3/04* (2012.01)

(52) U.S. Cl.
CPC ..... *D04H 3/04* (2013.01); *D10B 2501/04* (2013.01)

(58) Field of Classification Search
CPC ..... D04H 3/04; B65H 23/032; B65H 54/2836
See application file for complete search history.

(56) References Cited

U.S. PATENT DOCUMENTS 2,386,269 A 10/1945 Ryan
2,430,497 A 11/1947 Enright
3,296,490 A 1/1967 Price
3,477,180 A 11/1969 Robertson, Jr.
3,595,491 A * 7/1971 Bourque ..... B65H 65/005 242/475.7
4,049,211 A * 9/1977 Spescha ..... B65H 54/383 242/414.1
4,570,429 A * 2/1986 Guttler ..... D01H 13/1658 57/86
4,696,436 A * 9/1987 Whiteley ..... B65H 54/2881 242/476.7
4,724,612 A 2/1988 Pearson
5,706,590 A 1/1998 Candela et al.
(Continued)

FOREIGN PATENT DOCUMENTS

CN 102232671 A 11/2011
CN 102497792 A 6/2012
(Continued)

OTHER PUBLICATIONS

MAWS one—Martin Sallieres Martzer, Jul. 12, 2017, https://vimeo.com/225224055.

(Continued)

*Primary Examiner* — Jillian K Pierorazio
(74) *Attorney, Agent, or Firm* — Sterne, Kessler, Goldstein & Fox P.L.L.C.

(57) ABSTRACT

Winding apparatuses and methods for manufacturing an article of apparel. A winding apparatus can comprise a winding unit comprising a rotatable shaft, a thread guide movable along an axis perpendicular to the shaft, and a plate comprising a base coupled to the shaft and a plurality of projections extending from the base. The winding apparatus can also comprise a first actuator configured to rotate the shaft and a second actuator configured to move the thread guide along the axis and between respective projections of the plurality of projections to wind a continuous thread around the plurality of projections.

9 Claims, 20 Drawing Sheets

(56) References Cited

U.S. PATENT DOCUMENTS

| | | | | |
|---|---|---|---|---|
| 6,260,784 | B1 * | 7/2001 | Konig | B65H 65/00 242/476.4 |
| 7,540,097 | B2 | 6/2009 | Greene et al. | |
| 7,703,220 | B2 | 4/2010 | Aveni | |
| 7,774,884 | B2 | 8/2010 | Greene et al. | |
| 8,056,173 | B2 | 11/2011 | Rongbo | |
| 8,065,818 | B2 | 11/2011 | Greene et al. | |
| 8,850,723 | B2 | 10/2014 | Greene et al. | |
| 8,906,275 | B2 | 12/2014 | Davis et al. | |
| 8,925,195 | B2 | 1/2015 | Schmidt et al. | |
| 9,227,363 | B2 | 1/2016 | Dua et al. | |
| 9,402,444 | B2 | 8/2016 | Dojan et al. | |
| 9,427,047 | B2 | 8/2016 | Dojan et al. | |
| 9,462,851 | B2 | 10/2016 | Baker et al. | |
| 9,675,134 | B2 | 6/2017 | Kosui et al. | |
| 9,681,708 | B2 | 6/2017 | Greene et al. | |
| 9,732,454 | B2 | 8/2017 | Davis et al. | |
| 10,194,714 | B2 | 2/2019 | Mcginnity et al. | |
| 10,619,280 | B2 | 4/2020 | Luedecke et al. | |
| 10,874,172 | B2 | 12/2020 | Corcoran-Tadd et al. | |
| 10,993,497 | B2 | 5/2021 | Gaba | |
| 11,197,517 | B2 | 12/2021 | Manz et al. | |
| 11,718,936 | B2 | 8/2023 | Nordstrom | |
| 12,161,191 | B2 | 12/2024 | Corcoran-Tadd et al. | |
| 2004/0118018 | A1 | 6/2004 | Dua | |
| 2007/0271822 | A1 | 11/2007 | Meschter | |
| 2010/0018075 | A1 | 1/2010 | Meschter et al. | |
| 2010/0251491 | A1 | 10/2010 | Dojan et al. | |
| 2010/0251564 | A1 | 10/2010 | Meschter | |
| 2012/0023786 | A1 | 2/2012 | Dojan | |
| 2012/0055044 | A1 | 3/2012 | Dojan et al. | |
| 2012/0233882 | A1 | 9/2012 | Huffa et al. | |
| 2013/0019500 | A1 | 1/2013 | Greene | |
| 2013/0025159 | A1 | 1/2013 | Dojan et al. | |
| 2013/0219636 | A1 | 8/2013 | Dojan et al. | |
| 2013/0219750 | A1 | 8/2013 | Dojan et al. | |
| 2013/0248639 | A1 * | 9/2013 | Matthies | B65H 54/2839 242/472.6 |
| 2013/0340283 | A1 | 12/2013 | Bell et al. | |
| 2014/0068968 | A1 | 3/2014 | Podhajny et al. | |
| 2014/0130372 | A1 | 5/2014 | Aveni et al. | |
| 2014/0173938 | A1 | 6/2014 | Beye et al. | |
| 2014/0237861 | A1 | 8/2014 | Podhajny | |
| 2014/0373389 | A1 | 12/2014 | Bruce | |
| 2015/0040428 | A1 | 2/2015 | Davis et al. | |
| 2015/0047225 | A1 | 2/2015 | Zavala et al. | |
| 2015/0059209 | A1 | 3/2015 | Dekovic et al. | |
| 2015/0164175 | A1 | 6/2015 | Katsuya | |
| 2015/0250256 | A1 | 9/2015 | Podhajny | |
| 2015/0272274 | A1 | 10/2015 | Berns et al. | |
| 2015/0359290 | A1 | 12/2015 | Podhajny et al. | |
| 2016/0058100 | A1 | 3/2016 | Dealey et al. | |
| 2016/0058121 | A1 | 3/2016 | Langvin et al. | |
| 2016/0088893 | A1 | 3/2016 | Meir | |
| 2016/0135543 | A1 | 5/2016 | Anceresi et al. | |
| 2016/0168774 | A1 | 6/2016 | Breithaupt et al. | |
| 2016/0192741 | A1 | 7/2016 | Mark | |
| 2016/0206044 | A1 | 7/2016 | Dimoff et al. | |
| 2017/0035149 | A1 | 2/2017 | Bruce et al. | |
| 2017/0202296 | A1 | 7/2017 | Fuerst, Jr. et al. | |
| 2017/0202309 | A1 | 7/2017 | Sterman et al. | |
| 2017/0245582 | A1 | 8/2017 | Green et al. | |
| 2017/0347754 | A1 | 12/2017 | Fuerst, Jr. et al. | |
| 2018/0110298 | A1 | 4/2018 | Schneider et al. | |
| 2018/0148861 | A1 | 5/2018 | Tarrier et al. | |
| 2018/0271216 | A1 | 9/2018 | La O'et al. | |
| 2019/0274392 | A1 | 9/2019 | Amis et al. | |
| 2019/0380425 | A1 | 12/2019 | Wood et al. | |
| 2020/0154816 | A1 | 5/2020 | Gaba | |
| 2020/0397090 | A1 | 12/2020 | Meir et al. | |
| 2021/0100316 | A1 | 4/2021 | Corcoran-Tadd et al. | |
| 2021/0235807 | A1 | 8/2021 | Casillas et al. | |
| 2022/0007789 | A1 | 1/2022 | Corcoran-Tadd et al. | |
| 2022/0104588 | A1 | 4/2022 | Zinner et al. | |
| 2024/0164483 | A1 | 5/2024 | Corcoran-Tadd et al. | |
| 2024/0324699 | A1 | 10/2024 | Hirst et al. | |
| 2025/0098817 | A1 | 3/2025 | Corcoran-Tadd et al. | |
| 2025/0107583 | A1 | 4/2025 | Corcoran-Tadd et al. | |
| 2025/0213003 | A1 | 7/2025 | Dyckmans et al. | |
| 2025/0215621 | A1 | 7/2025 | Dyckmans et al. | |
| 2025/0215622 | A1 | 7/2025 | Dyckmans et al. | |
| 2025/0215626 | A1 | 7/2025 | Dietrich et al. | |

FOREIGN PATENT DOCUMENTS

| | | | |
|---|---|---|---|
| CN | 204207163 | U | 3/2015 |
| CN | 105263351 | A | 1/2016 |
| CN | 107072353 | A | 8/2017 |
| DE | 3003666 | A1 | 8/1981 |
| EP | 3549470 | A1 | 10/2019 |
| EP | 3780985 | B1 | 9/2021 |
| JP | 11006005 | Y | 12/1936 |
| JP | S4939620 | B1 | 10/1974 |
| JP | 2015014058 | A | 1/2015 |
| JP | 2016524941 | A | 8/2016 |
| JP | 2017148422 | A | 8/2017 |
| WO | WO-9843506 | A1 | 10/1998 |
| WO | WO-2014074928 | A1 | 5/2014 |
| WO | WO-2017115806 | A1 | 7/2017 |
| WO | WO-2017214199 | A1 | 12/2017 |

OTHER PUBLICATIONS

Modern Synthesis, "Evolution in the making," http://modern-synthesis.com; retrieved Jul. 13, 2020.

Martzer_, "2 hours to go!" Instagram.com, posted Jun. 27, 2017, https://www.instagram.com/p/BV1vc2KFXHq/.

Martzer_, "3d woven shoe" Instagram.com, posted Feb. 27, 2018, https://www.instagram.com/p/BftFi9siS4xl.

Martzer_, "Always experimenting! I wove some cotton thread on the last and stiffened it with latex. The outcome is interesting and promising for the future of my research. I shape the sole in hard foam!" Instagram.com, posted May 29, 2017, https://www.instagram.com/p/BUrTEigFmeX/.

Martzer_, "Experimenting with new material, and shapes! I am taking the opportunity here to thank you all for the upport and the likes!" Instagram.com, posted Sep. 25, 2017, https://www.instagram.com/p/BZd_qiSICKu/.

Martzer_, "I am back at it! This time it's to hopefully graduate from @design_academy_eindhoven I am continuing my dweaving and printing experiments from last semester and this is the first model! Stay posted if you want to follow the est of the process!" Instagram.com, posted Sep. 16, 2017, https://www.instagram.com/p/BZG217t1Rfu/.

Martzer_, "Small update on my research, this model is from two weeks ago. I'll be showing my final model on Tuesday or my last endterms before graduation! Stay posted . . . " Instagram.com, posted Jun. 22, 2017, https://www.instagram.com/p/BVpfr5pFVEf/.

Martzer_, "My outcome of the past two months! End terms are tomorrow, wish me luck! More photos of the project will come after tomorrow!" instagram.com, posted Jun. 26, 2017, https://www.instagram.com/p/BVzVqEiFw-a/.

Martzer_, "Off to graduation now! . . . " Instagram.com, posted Jun. 29, 2017, https://www.instagram.com/p/ BV7t3eSFolc/.

Martzer_, "Some close up shots of my graduation project "Shoelab" which you witnessed the process on my instram account throughout the past few month! Thank you all for the constant feedback and support! I hope you liked it!" instagram.com, posted Jan. 26, 2018, https://www.instagram.com/p/BeaOE5QIDIX/.

Martzer_, "The graduation period is coming to an end, one month left! Here is one of my latest experiments that I did a few weeks back! Also, any idea how to name this project? I'm struggling a bit haha" Instagram.com, posted Dec. 9, 2017, https:/lwww.instagram.com/p/Bc43txTFS36.

Martzer_, "Two weeks before green light good to have a small overview of my progress so far" Instagram.com, posted Nov. 6, 2017, https://www.instagrams.com/p/BbJ1dpqleah/.

Martzer_, "Yesterday I graduated Cum Laude from @design_academy_eindhoven! One of my project being this 3D Woven shoe!

(56) References Cited

OTHER PUBLICATIONS

More pictures to come!" Instagram.com, posted Jan. 24, 2018, https://www.instagram.com/p/ BeVw-21F26T/.

* cited by examiner

| | Connection length | Moved distance |
|---|---|---|
| **Connection 1 » 2** (1st thread line 602a) | 500 mm | 320 mm<br>$[(d_1 - d_{1.5}) + (d_2 - d_{1.5})]$ |
| **Connection 2 » 3** (2nd thread line 602b) | 510 mm | 384 mm<br>$[(d_2 - d_{2.5}) + (d_3 - d_{2.5})]$ |
| **Connection 3 » 4** (3rd thread line 602c) | 520 mm | 407 mm<br>$[(d_3 - d_{3.5}) + (d_4 - d_{3.5})]$ |
| **Connection 4 » 5** (4th thread line 602d) | 230 mm | 20 mm<br>$[d_4 - d_5]$ |
| ---------- | ---------- | ---------- |
| **Result** | **1760 mm** | **1131mm** |

FIG. 15

ROTATIONAL WINDING APPARATUS AND METHOD

FIELD

The described embodiments generally relate to apparatuses and methods for making apparel. In particular, described embodiments relate to apparatuses for winding one or more continuous threads around anchor points to create a material for apparel.

BACKGROUND

Apparel can be manufactured from various materials using a wide range of techniques, including weaving and knitting. Individuals are often concerned with the durability, comfort, and/or performance characteristics for an article of apparel. This is true for apparel worn for athletic and non-athletic activities. Proper apparel should be durable, comfortable, and provide other beneficial characteristics for an individual. Therefore, a continuing need exists for innovations in apparel and methods of making apparel to suit individuals across a range of use cases. Particularly, there is a need for methods of making materials for apparel that have customizable characteristics yet can be efficiently manufactured in large quantities and/or sizes.

BRIEF SUMMARY

A first embodiment (1) of the present application is directed to a winding apparatus for manufacturing an article of apparel, the winding apparatus comprising: a winding unit, comprising: a rotatable shaft, a thread guide, the thread guide movable along an axis perpendicular to the shaft, and a plate, the plate comprising a base coupled to the shaft and a plurality of projections extending from the base; a first actuator configured to rotate the shaft; and a second actuator configured to move the thread guide along the axis and between respective projections of the plurality of projections.

In a second embodiment (2), the thread guide according to the first embodiment (1) is movable along the axis between points that lie outside a perimeter of the plate regardless of an orientation of the plate.

In a third embodiment (3), the base according to any one of embodiments (1)-(2) is coupled to the shaft adjacent a center of mass of the plate.

In a fourth embodiment (4), the axis according to any one of embodiments (1)-(3) passes over the shaft.

In a fifth embodiment (5), a minimum diameter of the base according to any one of embodiments (1)-(4) is greater than or equal to half of a maximum diameter of the base.

In a sixth embodiment (6), each projection of the plurality of projections according to any one of embodiments (1)-(5) extends from the base at an angle from 90 to 175 degrees.

In a seventh embodiment (7), the winding apparatus according to any one of embodiments (1)-(6) comprises a plurality of winding units, wherein the shaft of each of the plurality of winding units is operationally coupled to the first actuator and the thread guide of each of the plurality of winding units is operationally coupled to the second actuator.

In an eighth embodiment (8), the winding apparatus according to any one of embodiments (1)-(6) comprises a plurality of winding units, a plurality of first actuators each operationally coupled to the shaft of a winding unit of the plurality of winding units, and a plurality of second actuators each operationally coupled to the thread guide of a winding unit of the plurality of winding units, wherein the plurality of first actuators are independently controllable and the plurality of second actuators are independently controllable.

In a ninth embodiment (9), the thread guide according to any one of embodiments (1)-(8) is slidably coupled to a bar.

A tenth embodiment (10) of the present application is directed to a method of making an article of apparel, the method comprising: rotating a plate on a rotation axis, the plate comprising a base and a plurality of projections extending from the base; dispensing a continuous thread via a thread guide, the thread guide movable laterally along an lateral axis; and moving the thread guide along the lateral axis and between respective projections of the plurality of projections to wind the continuous thread around the plurality of projections.

In an eleventh embodiment (11), in the method according to the tenth embodiment (10), only translation of the thread guide along the lateral axis and rotation of the plate on the rotation axis are required to wind the continuous thread around the plurality of projections.

In a twelfth embodiment (12), in the method according to any one of embodiments (10)-(11), a length of the continuous thread wound around the plurality of projections is greater than a distance traveled by the thread guide during winding of the length of the continuous thread.

In a thirteenth embodiment (13), the method according to any one of embodiments (10)-(12) further comprises changing at least one of a rotation rate or a rotation direction of the plate while moving the thread guide.

In a fourteenth embodiment (14), winding the continuous thread around the plurality projections according to any one of embodiments (10)-(13) forms a thread layer comprising a plurality of thread lines, with each thread line extending between two respective projections of the plurality of projections and across the plate.

In a fifteenth embodiment (15), the method according to the fourteenth embodiment (14) further comprises bonding thread lines of the plurality of thread lines to one another while the thread layer is on the plate.

In a sixteenth embodiment (16), the method according to any one of embodiments (14)-(15) further comprises cutting the thread layer while the thread layer is on the plate.

In a seventeenth embodiment (17), the method according to any one of embodiments (14)-(16) further comprises winding a second continuous thread around the plurality of projections to form a second thread layer comprising a second plurality of thread lines, with each thread line of the second plurality of thread lines extending between two respective projections of the plurality of projections and across the plate.

In an eighteenth embodiment (18), the plate according to any one of embodiments (10)-(17) is rotated on the rotation axis by a shaft coupled to the base, and the lateral axis passes over the shaft.

BRIEF DESCRIPTION OF THE DRAWINGS/FIGURES

FIG. 15 shows a table of distances for the thread lines of FIGS. 6-14B.

DETAILED DESCRIPTION

Figure 1B:
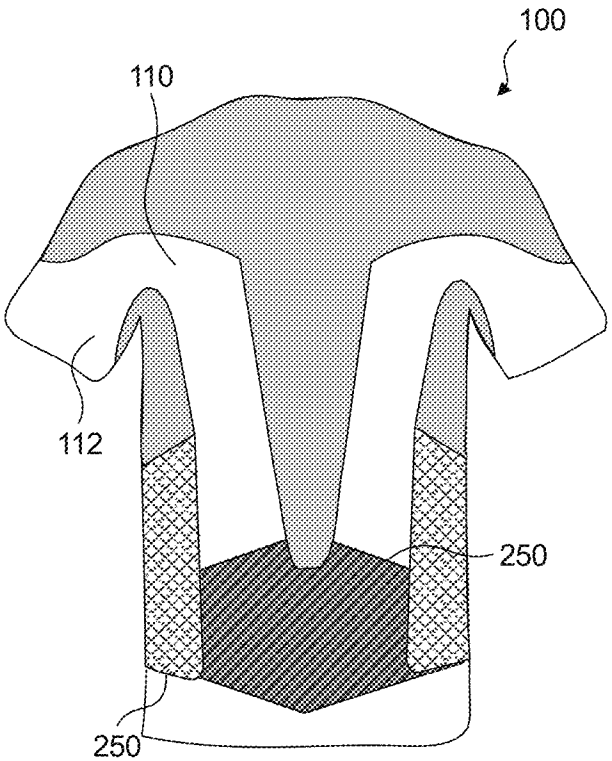
FIGS. 1A-1B show an article of apparel according to some embodiments.

The present invention(s) will now be described in detail with reference to embodiments thereof as illustrated in the accompanying drawings. References to "some embodiments", "one embodiment", "an embodiment", "an exemplary embodiment", etc., indicate that the embodiment described can comprise a particular feature, structure, or characteristic, but every embodiment may not necessarily comprise the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

As used herein, "thread" means a material having a length that is substantially larger than its width. A "thread" can be a filament, a fiber, a yarn, a cable, a cord, a fiber tow, a tape, a ribbon, a monofilament, a braid, a string, a plied thread, and other forms of materials which can be spooled and laid down in a thread pattern as described herein.

An article of apparel has many purposes. Among other things, apparel can provide a unique aesthetic look, provide warming or cooling characteristics, provide support for portions of an individual's body, and provide other performance characteristics, such as air permeability, moisture wicking properties, compression properties. Each of these purposes, alone or in combination, provides for comfortable apparel suitable for use in a variety of scenarios (for example, exercise and every day activities). The features of an article of apparel (for example, the materials and components used to make apparel, and the way these materials/components are made) can be altered to produce desired characteristics, for example, durability, stiffness, weight, tackiness, texture, haptics, tackiness, and/or air permeability.

Automated or partially automated production of an article of apparel can involve many different techniques. In some techniques, computer numeric control (CNC) can be used to automate the control and movement of components of an apparatus used to produce a material for the article of apparel. CNC can require programming computer software to execute desired movements of the components of the apparatus, such as movements required to wind a continuous thread around anchor points to create a thread layer or thread pattern, as described herein. In the embodiments described herein, simultaneous and/or successive movements of a plate comprising the anchor points and a thread guide that directs the continuous thread can be used to reduce the amount of movement required during production, leading to reduced manufacturing times.

The articles of apparel described herein can be made by, or can comprise a layer made by, winding one or more continuous threads around anchor points to create a desired thread layer or thread pattern. Winding the continuous thread(s) around the anchor points comprises wrapping a continuous thread around a first anchor point, extending that continuous thread to a second anchor point, wrapping that continuous thread around the second anchor point, and so on. The number and position of the anchor points can be utilized to control characteristics of the thread layer or thread pattern, and therefore characteristics of the apparel. Also, the number of times a continuous thread is wound from anchor point to anchor point can be utilized to control characteristics of the thread layer or thread pattern, and therefore characteristics of the apparel.

Continuous thread(s) of a thread layer or thread pattern can be bonded within the thread layer or thread pattern. The bonding of continuous thread(s) of a thread layer or thread pattern can consolidate the layer or pattern and fix thread lines within the layer or pattern. In some embodiments, bonding continuous thread(s) of a thread layer or thread pattern can be utilized to control characteristics of the layer or pattern. In some embodiments, a continuous thread can be bonded to itself within a thread layer or thread pattern. In some embodiments, a continuous thread can be bonded to itself at points of overlap between different thread lines of the continuous thread (i.e., at thread line intersection points). In some embodiments, different continuous threads of a thread layer or pattern can be bonded together. In some embodiments, different continuous threads can be bonded to each other at points of overlap between the different continuous threads (i.e., at intersection points between the different continuous threads). The bonding of continuous thread(s) can fix the continuous thread(s) in tension because the thread(s) can be wound around anchor points in tension.

In some embodiments, a plurality of different continuous threads can be wound around anchor points to form a plurality of thread layers for a thread pattern. In some embodiments, different continuous threads can be wound in the same configuration (i.e., around the same anchor points and along the same paths). In some embodiments, different continuous threads can be wound in different configurations (i.e., around one or more different anchor points and/or along different paths between one or more anchor points). In some embodiments, different continuous threads can define different wound layers for an article of apparel, or portion thereof. In such embodiments, the different layers can provide different characteristics to a thread pattern, and therefore provide different characteristics on the article of apparel.

Continuous thread(s) can be wound around anchor points (for example, projections as discussed herein) in various configurations to provide varying degrees of characteristics for an article of apparel. The number of anchor points, the position of the anchor points, the way continuous threads are wound around the anchor points, and/or of the material of threads wound around the anchor points can be utilized to produce apparel having desired characteristics, such as strength, stiffness, air permeability, comfort, abrasion resistance, fit, texture, haptics, tackiness, and durability. Characteristics of an article of apparel can be varied by changing the arrangement of anchor points and/or the way continuous thread(s) are wound around the anchor points. Characteristics can also be varied by altering the material of continuous thread(s).

In some embodiments, different thread layers or thread patterns can provide a first degree of a characteristic in one region of an article of apparel and a second degree of that characteristic in a second region of the article of apparel. In some embodiments, different thread layers or thread patterns can provide targeted characteristics to different regions of an article of apparel. In some embodiments, different thread layers or thread patterns can comprise thread lines oriented in different directions to provide targeted characteristics to different regions of an article of apparel.

In some embodiments, a thread layer or thread pattern can be bonded to the surface of one or more base layers. In some embodiments, a thread layer or thread pattern can be directly bonded to the surface of one or more base layers. In such embodiments, thread lines of the thread layer or thread pattern can be directly bonded to a surface of the base layer. Direct bonding to one or more base layers can impart unique characteristics on the base layer(s), and therefore the article of apparel. For example, direct bonding of a thread layer or thread pattern can impart desired mechanical or aesthetic properties to all or a portion of the article of apparel. In some embodiments, the direct bonding of a thread layer or thread pattern wound under tension can impart a compressive force on the surface of the base layer(s) once the thread pattern or thread layer is removed from anchor points. The compressive force can impart desired mechanical or aesthetic properties. For example, the compressive force can impart a desired shape to the article of apparel.

As used herein, two components (for example, a thread and a fabric) described as "bonded to" each other means the first component and second component are bonded to each other, either by direct contact and/or bonding between the two components or via an adhesive or bonding layer. Two components (for example, a thread and a fabric) described as "directly bonded to" each other means the two components are directly bonded to each other via a material of the first component, a material of the second component, or both. For example, where heat and/or pressure is utilized to directly bond the polymeric material of a thread to a base layer, the thread is directly bonded to the base layer via the polymeric material of thread. In such embodiments, the polymeric material can be thermally fused to the base layer.

Figure 1A:
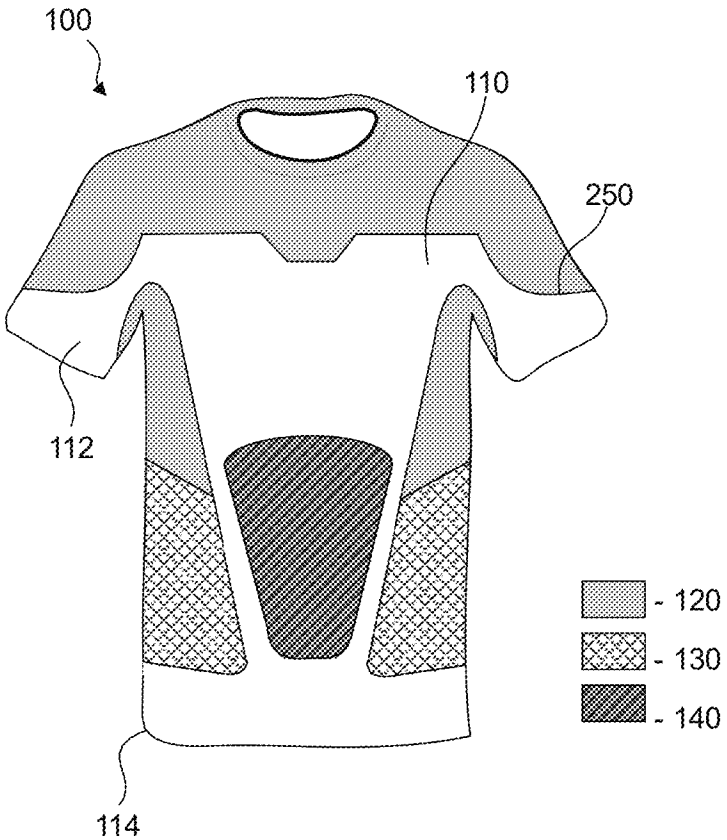

FIG. 1 illustrates an article of apparel 100 according to some embodiments. Article of apparel 100 can comprise one or more base layers 110 and one or more thread layers, for example, thread layers 120, 130, and 140. Thread layers 120, 130, 140 can be any exemplary thread layer described herein, for example, thread layers 200, 220, and 240. In some embodiments, a thread layer, for example thread layer 120, can comprise a plurality of thread layers (for example thread layer 200 and thread layer 220). In such embodiments, the thread layer can be referred to as a thread pattern comprising a plurality of thread layers. In some embodiments, article of apparel 100 may not comprise a base layer 110. In such embodiments, one or more thread layers (e.g., 120, 130, and 140), or one or more thread patterns comprising a plurality of thread layers can define all or a portion of article of apparel 100.

Article of apparel 100 can comprise any number of thread layers produced according to the embodiments of FIGS. 4-17. Each thread layer 120, 130, 140 (or a thread pattern) can be defined by one or more threads comprising a plurality of thread lines crossing over each other at points of overlap between two or more of the thread lines. Each thread line of a thread layer extends continuously across the thread layer (or thread pattern). Thread lines extending continuously across the thread layer (or thread pattern) are not woven or knitted threads. Similarly, thread lines extending continuously across the thread layer (or thread pattern) are not embroidered threads stitched to a base layer 110. Rather, the thread lines, and therefore the thread layer(s) are formed by winding thread around anchor points as described herein.

In some embodiments, thread lines extending continuously across the thread layer (or thread pattern) can extend continuously without forming a knitted structure or a woven structure between opposing ends of the thread lines. In some embodiments, thread lines extending continuously across the thread layer (or thread pattern) can extend continuously without forming a knitted structure or a woven structure along a distance greater than or equal to at least 90% of the length of the thread lines measured between opposing ends of the thread lines. In some embodiments, thread lines extending continuously across the thread layer (or thread pattern) can extend continuously without forming an embroidered structure between opposing ends of the thread lines. In some embodiments, thread lines extending continuously across the thread layer (or thread pattern) can extend continuously without forming an embroidered structure along a distance greater than or equal to at least 90% of the length of the thread lines measured between opposing ends of the thread lines.

In some embodiments, thread lines of thread layer(s) 120, 130, 140 can be bonded to a surface 112 of a base layer 110 along at least a portion of a length of the thread line. In some embodiments, thread lines of thread layer(s) 120, 130, 140 can be directly bonded to a surface 112 of a base layer 110 along at least a portion of a length of the thread line. In some embodiments, surface 112 can be an exterior surface of base layer 110 facing away from a wearer's body during use. In some embodiments, surface 112 can be an interior surface of base layer 110 facing towards a wearer's body during use. In some embodiments, article of apparel 100 can comprise one or more thread layers bonded (or directly bonded) to an exterior surface of a base layer 110 and one or more thread layers bonded (or directly bonded) to an interior surface of the base layer 110.

In some embodiments, thread layers 120, 130, 140 can be bonded to different regions on surface 112 of a base layer 110. In some embodiments, thread layers 120, 130, 140 can define all or a portion of different regions of an article of apparel 100. Article of apparel 100 can comprise any number of thread layers (or thread patterns) bonded to or defining different regions of the article of apparel 100. For example, FIG. 1 illustrates article of apparel 100 comprising a first thread layer 120 bonded to a first region on article of apparel 100, a second thread layer 130 bonded to a second region on article of apparel 100, and a third thread layer 140 bonded to a third region on article of apparel 100. In such embodiments, the thread border 250 of each thread layer can define the respective regions on the article of apparel 100. In some embodiments, thread layers (or thread patterns) can overlap in an overlap region. Article of apparel 100 can comprise any thread layer produced according to the embodiments of FIGS. 4-17.

In some embodiments, thread layers 120, 130, 140 (or a thread pattern comprising a thread layer 120, 130, 140) can wrap entirely around all or a portion of the article of apparel 100. For example, a thread layer 120, 130, 140 (or thread pattern) can wrap entirely around all or a portion of article of apparel 100 to provide support for a wearer's joint during use. A thread layer (or thread pattern) can wrap entirely around a pant leg, a sleeve, a waist, a torso portion, an abdomen portion, or a chest portion of article of apparel 100.

Thread layers (or thread patterns) applied to different regions of an article of apparel can impart desired characteristics to the respective regions. Exemplary characteristics comprise, but are not limited to, strength, support, breathability, comfort (stretchability), aesthetics, abrasion resistance, water resistance, texture, tackiness, and haptics. In some embodiments, the material of a continuous thread used to wind a thread layer can impart the desired characteristics. For example, a thread layer wound using a hydrophobic thread can impart water resistance to a particular region on an article of apparel. In some embodiments, the tension at which a continuous thread is wound can impart the desired characteristics. For example, a thread wound at high tension can impart a high degree of compression for a particular region on article of apparel.

In some embodiments, each thread layer 120, 130, 140 (or a thread pattern) can occupy a surface area defined by a thread border 250 (for example, border 250*a*, 250*b*, or 250*c*). In some embodiments, each thread layer 120, 130, 140 (or thread pattern) can occupy a surface area defined by a thread border 250 (for example, border 250*a*, 250*b*, or 250*c*) on the surface 112 of a base layer 110. Each thread line within a thread layer (or thread pattern) can extend continuously across the layer and comprise a first end disposed at the thread border and a second end disposed at the thread border. In some embodiments, the first end and the second end of each thread line can be bonded to the surface 112 of the base layer 110. In some embodiments, the first end and the second end of each thread line can be directly bonded to the surface 112 of the base layer 110.

In some embodiments, a thread layer or thread pattern can be visibly exposed on surface 112 of article of apparel 100. In some embodiments, no lamination layer or supporting textile layer is disposed over a thread layer or thread pattern on the surface 112 of article of apparel 100. In some embodiments, a region on article of apparel 100 comprising a thread layer or thread pattern can be devoid of a lamination layer.

In some embodiments, the surface area of a first thread layer (or thread pattern) and the surface area of a second thread layer (or thread pattern) can partially overlap on article of apparel 100 in an overlap region. In some embodiments, the surface area of a first thread layer (or thread pattern) and the surface area of a second thread layer (or thread pattern) can partially overlap on the surface 112 of a base layer 110 in an overlap region. In such embodiments, the first thread layer (or thread pattern) and the second thread layer (or thread pattern) can overlap partially on article of apparel 100. In some embodiments, the first thread layer (or thread pattern) and the second thread layer (or thread pattern) can be bonded to each other at an area of overlap between first thread layer (or thread pattern) and the second thread layer (or thread pattern). In some embodiments, the first thread layer (or thread pattern) and the second thread layer (or thread pattern) can be directly bonded to each other at an area of overlap between first thread layer (or thread pattern) and the second thread layer (or thread pattern).

In some embodiments, one or more of thread layers 120, 130, 140 (or a thread pattern) can occupy a surface area defined by a thread border that is the same as a perimeter edge 114 of a base layer 110. In such embodiments, the one or more of thread layers 120, 130, 140 (or a thread pattern) can comprise a surface area occupying the entirety of a base layer 110. In some embodiments, one or more of thread layers 120, 130, 140 (or a thread pattern) can occupy a surface area defined by a thread border that is at least partially surrounded by perimeter edge 114 of a base layer 110. In such embodiments, perimeter edge 114 can define a surface area that at least partially comprises the surface area defined by the thread border. In some embodiments, one or more of thread layers 120, 130, 140 (or a thread pattern) can occupy a surface area defined by a thread border that is surrounded by perimeter edge 114 of a base layer 110. In such embodiments, perimeter edge 114 can define a surface area that wholly comprises the surface area defined by the thread border.

In some embodiments, thread lines of a thread layer (or thread pattern) can apply a compressive force on the surface 112 of the base layer 110, the compressive force being applied along an axis extending from a first end to a second end of the thread line. In such embodiments, the compressive force applied via each thread line can be configured to impart a desired shape on an article of apparel.

In some embodiments, the base layer 110 can comprise a single piece of material. In some embodiments, base layer 110 can comprise a plurality of pieces of material. In such embodiments, base layer 110 can comprise a first piece of material and a second piece material adjacent to the first piece of material. Pieces of material located adjacent to each other can be disposed in a side-by-side relationship with the perimeter edge of the first piece adjacent to the perimeter edge of the second piece. In some embodiments, the first piece of material and a second piece material can be joined at a seam. In some embodiments, the first piece of material and a second piece material may not be joined at a seam such that there is a gap between the adjacent pieces of material. In either case, one or more of the thread lines for a thread layer 120, 130, 140 (or a thread pattern) can extend across and be bonded to both the first piece of material and the second piece of material. In some embodiments, one or more of the thread lines for a thread layer 120, 130, 140 (or a thread pattern) can extend across and be directly bonded to both the first piece of material and the second piece of material.

As used herein, a "seam" is any attachment region between two portions of a single material piece or two different material pieces. Exemplary attachment regions comprise, but are not limited to, stitched attachment regions, adhesive attachment regions, thermally bonded attachment regions, and interlocking attachments. Exemplary seam structures comprise, but are not limited to, a self-attaching seam, a hem, a butt stich, a Merrow stitch (tight overlock stitch), a gathered edge, a surge stitch, an overlock stitch, and an interlocking seam construction. In some embodiments, a "seam" can comprise a region where two portions of a single material piece or two different material pieces overlap. For example, a seam can be a region where a first piece of material overlaps and is bonded to a second piece of material.

In some embodiments, base layer 110 can comprise three or more adjacent pieces of material. For example, base layer 110 can comprise three, four, five, six, seven, eight, nine, or ten pieces of material.

In some embodiments, base layer 110, or a piece of material defining base layer 110, can comprise a fabric material. In some embodiments, the fabric material can be a non-woven, woven, or knitted fabric material. In some embodiments, base layer 110, or a piece of material defining base layer can comprise a foam material. Exemplary fabric materials for base layer 110 comprise, but are not limited to, thermoplastic polyurethane (TPU), polyester, polyamide, polyethylene (PE), PE foam, polyurethane (PU) foam, nylon, ultra-high molecular weight polyethylene (for example, DYNEEMA® (a type of ultra-high molecular weight polyethylene)), carbon fiber, KEVLAR® (a type of para-aramid), synthetic spider silk, cotton, wool, natural or artificial silk, polyethersulfone (PES), ELASTAN® (a polyether-polyurea copolymer), or a blend of two or more of these materials. In some embodiments, base layer 110, or a piece of material defining base layer 110, can comprise a polymeric sheet or film, for example, a TPU sheet or film. In some embodiments, base layer 110, or a piece of material defining base layer 110, can comprise a mesh material.

In some embodiments, base layer 110, or a piece of material defining base layer 110, can comprise a first base layer disposed below a thread layer or thread pattern and a second base layer disposed above the thread layer or thread pattern. In such embodiments, the thread layer or thread pattern can be sandwiched between the first base layer and the second base layer. Also in such embodiments, thread lines of the thread layer or thread pattern can be (i) bonded to a surface 112 of the first base layer along at least a portion of a length of the thread line, (ii) bonded to a surface 112 of the second base layer along at least a portion of a length of the thread line, or (iii) both. In some embodiments, the thread lines can be directly bonded to the surface 112 of the first base layer, directly bonded to a surface 112 of the second base layer, or both.

While article of apparel 100 is depicted as a shirt in FIG. 1, other types of apparel comprising a thread layer 120, 130, 140 (or a thread pattern) as described herein are contemplated. As used herein, "apparel" can be any item that is worn or adorns an individual, including both clothing and accessories. Clothing can comprise, but is not limited to pants, shorts, leggings, socks, a shoe, a shoe upper, a jacket, a coat, a hat, a sleeve, a sweater, a shirt, a bra, a jersey, a bootie, a glove, an arm sleeve, a knee sleeve, an elbow sleeve, a wrist sleeve, an ankle sleeve. Accessories can comprise, but are not limited to a headband, a waistband, a belt, a wristband, a bracelet, a watch band, a shoulder wrap, a tape, a shin guard, a hat, a tie, a scarf, a purse, a handbag, a wallet, a knapsack, or a backpack.

Thread layers as described herein (for example, thread layers 200, 220, and 240) can each comprise a thread border 250 defined by the space in which thread lines of the thread layer are located. The thread border 250 for a thread layer is the space in which thread lines of the thread layer are located after the thread layer is removed (for example, cut) from anchor points used to wind the thread layer. A plurality of thread lines within a thread pattern can comprise a first end located at a first side of the thread border 250 and a second end located at a second side of the thread border 250. For example, thread lines 204 of thread layer 200 can comprise a first end 210 located at a first side of thread border 250 and a second end 212 located at a second side of thread border 250.

Figure 2A:
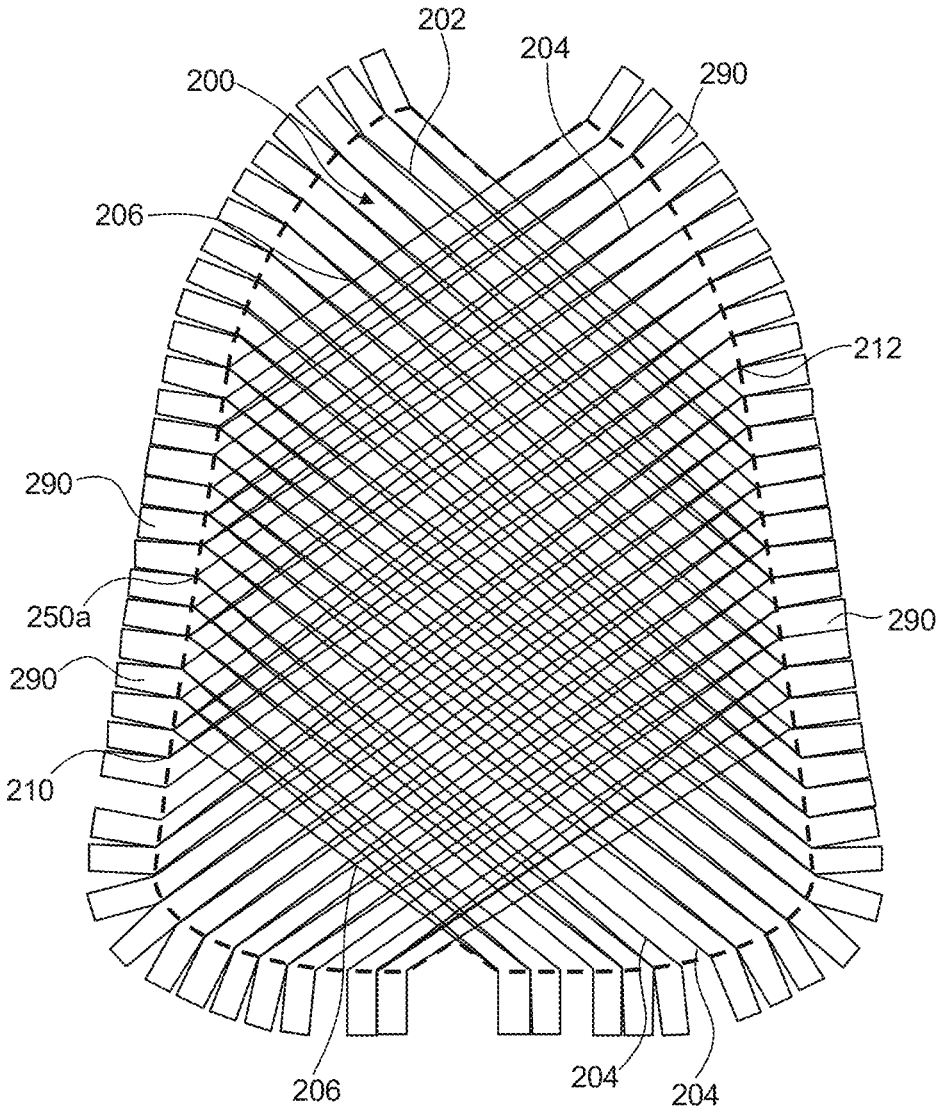
FIGS. 2A-2C show thread layers according to some embodiments.
Figure 2B:
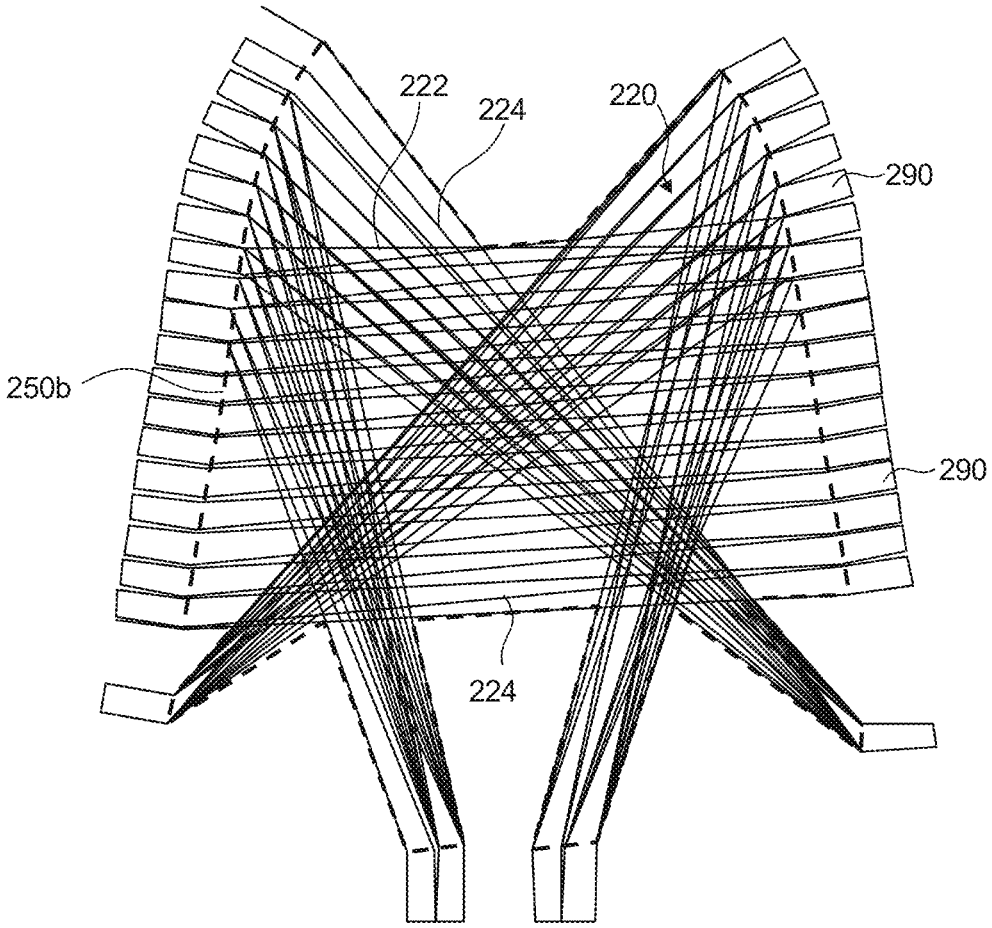
Figure 2C:
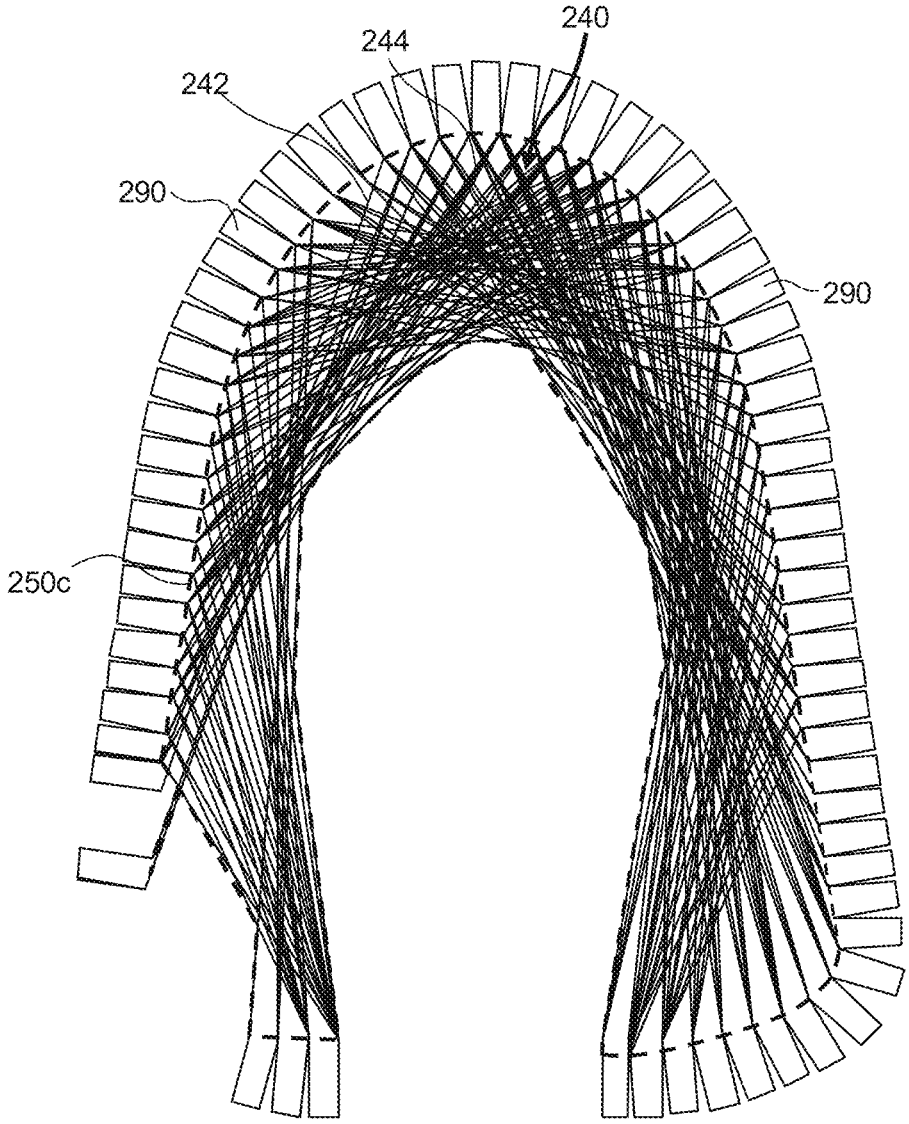

FIGS. 2A-2C illustrate thread borders 250*a-c* for thread layers 200, 220, and 240. For a thread pattern comprising a plurality of thread layers, the thread pattern can comprise a thread pattern border 250 defined by the space occupied by the combination of the individual thread layers. For example, a thread pattern comprising thread layers 200, 220, and 240 comprises a thread pattern border defined by the space occupied by the combination of border 250*a* and border 250*c*. Border 250*b* is wholly contained within border 250*a*.

As used herein, sides of a perimeter edge or a border refer to top, bottom, right, and left sides of a shape defined by the edge or border. The top, bottom, right, and left sides of the shape are located to the top, bottom, right, and left of a geometrical center of the shape. So, a perimeter edge or border will have a top side defined by the portion of the edge located above the geometrical center, a bottom side defined by the portion of the edge located below the geometrical center, a right side defined by the portion of the edge or border located to the right of the geometrical center, and a left side defined by the portion of the edge or border located to the left of the geometrical center. The top and bottom sides do not overlap. Similarly, the left and right sides do not overlap. The top and left sides overlap at the portion of the edge or border located to the top-left of the geometrical center. The top and right sides overlap at the portion of the edge or border located to the top-right of the geometrical center. The bottom and left sides overlap at the portion of the edge or border located to the bottom-left of the geometrical center. The bottom and right sides overlap at the portion of the edge or border located to the bottom-right of the geometrical center. For purposes of determining the shape defined by the perimeter edge or border, the material having the edge or border is laid in a flat configuration with no portion of the material overlapping itself.

As used herein, a first side of a perimeter edge or border can be the top, bottom, right, or left side of the edge or border and a second side of the perimeter edge can be the top, bottom, right, or left side of the edge or border, provided that the first and second sides are not the same side. Similarly, a third side of a perimeter edge or border can be the top, bottom, right, or left side of the edge or border and a fourth side of the edge or border can be the top, bottom, right, or left side of the edge or border, provided that the third and fourth sides are not the same, and are not the same as the first or second sides.

In some embodiments, one or more thread layers (for example, thread layers 120, 130, 140) can comprise a thread defining (i) a plurality of thread lines each extending from a first side of a thread border to a second side of the thread border and crossing over each other at points of overlap between two or more of the thread lines, and (ii) a plurality of thread lines each extending from a third side of the thread border to a fourth side of the thread border and crossing over each other at points of overlap between two or more of the thread lines. The thread lines extending from the first side to the second side can extend continuously from the first side to the second side, and the thread lines extending from the third side to the fourth side can extend continuously from the third side to the fourth side.

Thread layer 200 comprises a continuous thread 202 wound around anchor points 290. Thread layer 220 comprises a continuous thread 222 wound around anchor points 290. Thread layer 240 comprises a continuous thread 242 wound around anchor points 290. In some embodiments, anchor points 290 can be different sets of anchor points around which different thread layers are wound. In some embodiments, a plurality of thread layers can wound around the same set of anchor points 290. In such embodiments, separate thread layers can be wound over each other, with one thread layer disposed over one or more other thread layers.

As used herein, "anchor point" means a location to which a thread or group of thread lines is fixedly attached. A thread or thread line can be wrapped, wound, bonded, or otherwise attached at an anchor point. In some embodiments, an anchor point can be a location on an article of apparel. For example, an anchor point can be a hole or opening left behind by a structure (for example, pin, projection, or nub) used to wind continuous thread(s) of a thread layer and/or thread pattern. In some embodiments, a thread layer or thread pattern for an article of apparel may not comprise any anchor point locations because all the anchor point locations present during winding of the thread layer or thread pattern have been removed (for example, cut off). An anchor point can be a structure (for example, pin, projection, or nub) used to wind continuous thread(s) of a thread layer and/or thread pattern. And the anchor point structure may or may not form a portion of a thread layer or thread pattern for an article of apparel.

A continuous thread wrapped or wound around an anchor point need not be wrapped or wound completely (i.e., 360 degrees) around the anchor point. A continuous thread wrapped or wound around an anchor point can be wrapped or wound around only a portion of the anchor point. For example, a continuous thread wrapped or wound around an anchor point can be wrapped or wound around 25% (90 degrees) of an anchor point's perimeter, 50% (180 degrees) of an anchor point's perimeter, 75% (270 degrees) of an anchor point's perimeter, or 100% (360 degrees) of an anchor point's perimeter. In some embodiments, a continuous thread can be wrapped or wound around an anchor point's perimeter more than once before being threaded to the next anchor point. For example, a continuous thread can be wrapped or wound around an anchor point's perimeter one and a half times (540 degrees) or twice (720 degrees) before being threaded to the next anchor point.

Continuous thread 202 can be wrapped around a plurality of anchor points 290 and comprises a plurality of thread lines 204. Each thread line 204 extends between two respective anchor points 290.

Continuous thread 202 can be wrapped around a plurality of anchor points 290 in tension such that individual thread lines 204 are in tension when wrapped around anchor points 290. In some embodiments, the tension at which thread lines 204 are wound can range from 0 centinewtons (cN) to 25 cN, including subranges. For example, in some embodiments, the tension at which thread lines 204 are wound can range from 0.01 cN to 25 cN, from 0.1 cN to 25 cN, from 1 cN to 25 cN, from 5 cN to 25 cN, from 10 cN to 25 cN, or from 15 cN to 25 cN. In some embodiments, the tension at which thread lines 204 are wound can range from 2 cN to 10 cN. In some embodiments, the tension at which thread lines 204 are wound can range from 2 cN to 6 cN. In such embodiments, the tension can create the compressive force applied along thread lines as described herein. In some embodiments, the compressive force can range from 0 cN to 25 cN, including subranges. For example, in some embodiments, the compressive force can range from 0.01 cN to 25 cN, from 0.1 cN to 25 cN, from 1 cN to 25 cN, from 5 cN to 25 cN, from 10 cN to 25 cN, or from 15 cN to 25 cN. In some embodiments, the compressive force can range from 2 cN to 10 cN. In some embodiments, the compressive force can range from 2 cN to 6 cN.

Thread lines 204 directly bonded to surface 112 of base layer 110 can apply a compressive force on the surface 112 along an axis extending from a first end 210 to second end 212 of the thread line 204. This compressive force can be the result of the thread lines 204 being wound around anchor points under tension and being directly bonded to the surface while still under tension.

In some embodiments, different thread lines 204 can be wrapped around anchor points 290 at different tensions to impart desired characteristics to thread layer 200. In some embodiments, a first set of thread lines 204 can be wound at a first tension in any of the centinewton ranges described above and a second set of thread lines 204 can be wound at a second tension in any of the centinewton ranges described above, where the first tension is greater than or less than the second tension. In some embodiments, the first tension can be at least 0.5 cN greater than or less than the second tension. In some embodiments, the first tension can be at least 1 cN greater than or less than the second tension.

In embodiments where different thread lines 204 are wound at different tensions, different thread lines 204 of thread layer 200 will be under different values of tension in thread layer 200. The tension of thread lines 204 can be utilized to control characteristics of thread layer 200, and therefore an article of apparel comprising thread layer 200.

The number of thread lines 204 for thread layer 200 fixed at an anchor point 290 is defined by the "thread line communication number" of an anchor point 290. As used herein, "thread line communication number" means the number of thread lines extending from an anchor point to different anchor points. Two thread lines extending between the same two anchor points (i.e., overlaying thread lines) only counts as "1" for purposes of calculating a thread line communication number for the anchor points. For example, a thread line communication number of five means that an anchor point has five thread lines extending from it with each of the five thread lines leading to another, different anchor point. As another example, a thread line communication number of six means that an anchor point has six thread lines extending from it with each of the six thread lines leading to another, different anchor point.

Similarly, the number of thread lines fixed at an anchor point 290 for a thread pattern comprising a plurality of thread layers is defined by the "thread line communication number" of an anchor point 290 for the thread pattern. For a thread pattern, the "thread line communication number" of an anchor point 290 is the total number of thread lines, for the plurality of layers, extending from an anchor point to different anchor points.

Anchor points 290 can have a thread line communication number of "X" or more for a thread layer or a thread pattern. In some embodiments, two or more respective anchor points 290 can have a thread line communication number of "X" or more. In some embodiments, all the anchor points 290 for a thread layer or a thread pattern can have a thread line communication number of "X" or more. "X" can be, for example, 2, 3, 4, 5, 6, 7, 8, 9, 10, 15, 20, 25, 30, 35, 40, 45, or 50, within a range having any two of these values as end points. For example, in some embodiments "X" can be in a range of 2 to 50, 3 to 50, 4 to 50, 5 to 50, 6 to 50, 7 to 50, 8 to 50, 9 to 50, 10 to 50, 15 to 50, 20 to 50, 25 to 50, 30 to 50, 35 to 50, 40 to 50, or 45 to 50. In some embodiments, "X" can be greater than 50. In some embodiments, "X" can range from 2 to 100, 10 to 100, 20 to 100, 10 to 200, 20 to 200, 50 to 200, 10 to 300, 20 to 300, or 50 to 300.

A thread layer, for example thread layer 200, can comprise any suitable number of thread lines. In some embodiments, a thread layer can comprise 10 or more thread lines. In some embodiments, a thread layer can comprise 20 or more thread lines. In some embodiments, a thread layer can comprise 50 or more thread lines. In some embodiments, a thread layer can comprise 100 or more thread lines. In some embodiments, a thread layer can comprise 200 or more thread lines. In some embodiments, a thread layer can comprise 300 or more thread lines. In some embodiments, a thread layer can comprise 500 or more thread lines. In some embodiments, a thread layer can comprise a number of thread lines in a range of 10 to 300. For example, a thread layer can comprise 10 to 300, 50 to 300, 100 to 300, or 150 to 300 thread lines. In some embodiments, a thread layer can comprise 10 to 500 thread lines. In some embodiments, a thread layer can comprise 100 to 500 thread lines. In some embodiments, a thread layer can comprise 100 to 1000 thread lines.

In some embodiments, thread lines 204 can be bonded at anchor points 290. In such embodiments, thread lines 204 can be bonded at anchor points 290 via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s).

In some embodiments, thread lines 204 can be directly bonded together at anchor points 290. In some embodiments, thread lines 204 can be directly bonded together at anchor points 290 via a polymeric material of continuous thread 202. For example, heat and/or pressure can be applied to directly bond thread lines 204 at anchor points 290. In embodiments where heat and/or pressure is utilized to directly bond the polymeric material of thread lines 204, the thread lines 204 can be thermally fused together at one or more anchor points 290. In embodiments comprising direct bonding of thread lines 204 at anchor points 290, thread lines 204 can be directly bonded at anchor points 290 without the use of an adhesive or bonding layer.

In some embodiments, thread lines 204 can be bonded together via a bonding layer. In some embodiments, thread lines 204 can be bonded together at anchor points 290 via a bonding layer. In such embodiments, the bonding layer can be, for example, a laminated layer, an adhesive layer, a stitched layer, a cured layer, a screen-printed layer, or a blown fiber layer. In some embodiments, the blown fiber layer can comprise polymeric fibers that can bond thread lines 204.

In some embodiments, thread lines 204 can be bonded together without the use of a bonding layer. For example, in some embodiments, thread lines 204 can be directly bonded together via, for example, but not limited to, direct local bonding via material(s) of thread lines 204, needle punching, hydro-entanglement, and ultrasonic/vibratory entanglement.

In some embodiments, thread lines 204 can be bonded at points where two or more thread lines 204 overlap in thread layer 200 (i.e., intersection points 206). Thread lines 204 can be bonded at intersection points 206 via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). Intersection points 206 for thread lines can be referred to as "overlap points" or "points of overlap."

In some embodiments, thread lines 204 can be directly bonded together at intersection points 206. In some embodiments, thread lines 204 can be directly bonded together at intersection points 206 via the polymeric material of continuous thread 202. In embodiments comprising direct bonding of thread lines 204 at intersection points 206, thread lines 204 can be bonded at intersection points 206 without the use of an adhesive or bonding layer. For example, heat and/or pressure can be applied to thread layer 200 to directly bond thread lines 204 at intersection points 206. In embodiments where heat and/or pressure is utilized to directly bond the polymeric material of thread lines 204, the thread lines 204 can be thermally fused together at one or more intersection points 206.

In some embodiments, a bonding layer can bond thread lines 204 together at a plurality of intersection points 206 within thread layer 200. In such embodiments, the bonding layer can be, for example, a laminated layer, an adhesive layer, a stitched layer, a cured layer, a screen-printed layer, or a blown fiber layer comprising polymeric fibers that can bond thread lines 204.

In some embodiments, continuous thread 202 can comprise overlaying thread lines 204. As used herein, "overlaying thread lines" means two or more thread lines that follow the same path between two respective anchor points. Overlaying thread lines need not be overlaid directly over each other. Two or more thread lines are considered overlaying as long as they extend between the same two anchor points.

In some embodiments, the thread lines 204 of thread layer 200 may not be woven or knitted together. In such embodiments, thread lines 204 can be referred to as "non-woven" and "non-knitted" thread lines. In some embodiments, the thread lines 204 of thread layer 200 may not be embroidered threads stitched to a base layer. In such embodiments, thread lines 204 may be referred to as "non-embroidered" thread lines.

In some embodiments, continuous thread 202 can be a polymer thread. As used herein, "polymer thread" means a thread composed at least in part of a polymeric material. In some embodiments, a polymer thread can be composed entirely of one or more polymeric materials. In some embodiments, a polymer thread can comprise a polymeric material coated around a core (which may or may not be composed of a polymeric material). In such embodiments, the core can be encapsulated by the coating material. In some embodiments, a polymer thread can comprise a non-polymer core coated, covered, or encapsulated with a polymeric material. In some embodiments, a polymer thread can comprise a polymer core coated, covered, or encapsulated with a non-polymeric material. In some embodiments, a polymer thread can be a braided thread with one or more braids composed of a polymeric material. In some embodiments, the polymeric material(s) of a polymer thread can be thermoplastic material(s). In some embodiments, continuous thread 202 can be a thread coated with an activatable agent, for example a heat activated adhesive or a UV-activated adhesive. In some embodiments, a CNC machine for winding a continuous thread 202 with an activatable agent coating can comprise a robotic arm for activating the coating as continuous thread 202 is being wound around anchor points 290. In some embodiments, the coating can be activated by thread guide 480.

Suitable polymeric materials for polymer threads discussed herein comprise, but are not limited to, thermoplastic polyurethane (TPU), a rubber, and silicone. In some embodiments, the TPU can be recycled TPU. In some embodiments, the polymeric material can be a photo-reactive (infrared or ultraviolet light reactive) polymeric material, such as a photo-reactive TPU. In some embodiments, the polymeric material can be soluble (for example, water-soluble). In embodiments comprising polymer threads with a coated core, suitable materials for the core comprise, but are not limited to, polyester, nylon, ultra-high molecular weight polyethylene (for example, DYNEEMA® (a type of ultra-high molecular weight polyethylene)), carbon fiber, KEVLAR® (a type of para-aramid), bioengineered woven, knit or layered materials (for example, synthetic spider silk), woven, knit or layered plant based materials, cotton, wool, and natural or artificial silk. In some embodiments, polymer threads can be thermoplastic polyurethane coated polyester threads. In some embodiments, continuous thread 202 can be a non-polymer thread composed of non-polymer materials, such as carbon fiber, cotton, wool, or silk. In some embodiments, continuous thread 202 can be a thread composed of a biomaterial, such as mango yarn or bio-silk. In some embodiments, polymer threads can be a thermoplastic melt yarn, polymer yarn with non-melt core, and other similar types of yarn.

In some embodiments, the polymeric material for polymer threads can comprise a melting temperature in a range of greater than or equal to 110° C. to less than or equal to 150° C. In such embodiments, the polymeric material can be referred to as a "low melting temperature polymeric material."

In some embodiments, continuous thread 202 can be a plied thread. In some embodiments, the plied thread can be plied while winding thread 202. For example, a winding unit 450 used to wind thread 202 can ply the thread using thread from a plurality of thread spools (see for example, winding unit 450). In some embodiments, the plied thread can be a pre-plied thread spooled around a thread spool.

In some embodiments, continuous thread 202 of thread layer 200 can have a denier in the range of from 1 denier to 3000 denier, including subranges. For example, continuous thread 202 can have a denier of 1, 10, 50, 100, 200, 300, 400, 500, 600, 700, 800, 900, 1000, 1100, 1200, 1300, 1400, 1500, 1600, 1700, 1800, 1900, 2000, 2500, or 3000 denier, or within any range having any two of these values as endpoints. For example, in some embodiments, continuous thread 202 can have a denier in the range of from 10 denier to 2500 denier, from 50 denier to 2000 denier, from 100 denier to 1900 denier, from 200 denier to 1800 denier, from 300 denier to 1700 denier, from 400 denier to 1600 denier, from 500 denier to 1500 denier, from 600 denier to 1400 denier, from 700 denier to 1300 denier, from 800 denier to 1200 denier, from 900 denier to 1100 denier, or from 900 denier to 1000 denier.

Thread patterns as described herein can comprise any number of thread layers. For example, a thread pattern can comprise two or more, three or more, four or more, five or more, six or more, seven or more, eight or more, nine or more, ten or more, fifteen or more, or twenty or more thread layers. For example, a thread pattern can comprise thread layer 200, thread layer 220, and thread layer 240.

Continuous threads of any thread layer (for example, thread layers 220 and 240) can be wound around and extended between anchor points 290 in the same fashion as described above for continuous thread 202. Further, thread lines of the continuous threads of any thread layer (for example, thread layers 220 and 240) can be bonded in the same manner as described above for thread layer 200.

Like continuous thread 202, continuous threads for other thread layers (for example, threads 222 and 242) can comprise a plurality of thread lines (for example, thread lines 224 and 244) wound around and extending between two respective anchor points. In some embodiments, continuous threads of different thread layers can be the same thread material. In some embodiments, continuous threads of different thread layers can be composed of different thread materials. In such embodiments, the materials for different continuous threads in a thread pattern can be selected to provide targeted characteristics to areas of a thread pattern, and therefore an article of apparel. In some embodiments, the denier of continuous threads in different thread layers within a thread pattern can be selected to provide varying degrees of a characteristic (for example, strength or stretchability) to different areas of the thread pattern.

In embodiments comprising a thread pattern with a plurality of thread layers, the plurality of thread layers can be layered over each other. For example, thread layer 200 can define a first layer of a thread pattern and a second thread layer 220 can define a second layer of the thread pattern. Different thread layers of a thread pattern can be disposed over each other in areas of overlap between the two thread layers. For example, a first thread layer 200 can be disposed over second thread layer 220, or vice versa, in areas of overlap between the two thread layers.

In embodiments comprising a thread pattern with a plurality of thread layers, the plurality of thread layers can be bonded to each other in the thread pattern. In some embodiments, one or more of the layers can be directly bonded to each other via the polymeric material of a continuous thread defining thread lines for at least one of the layers. In some embodiments, one or more of the layers can be bonded via a bonding layer. In such embodiments, the bonding layer can be, for example, a laminated layer, an adhesive layer, a stitched layer, a cured layer, a screen-printed layer, or a blown fiber layer. In some embodiments, the bonding layer can be a non-woven bonding layer.

In some embodiments, one or more thread layers of a thread pattern can serve to bond other thread layers of the thread pattern together. In such embodiments, these one or more thread layers can be wound using a polymeric thread, which when heated, bonds other layers of the thread pattern together at anchor points and/or intersection points between continuous threads. For example, in a thread pattern comprising three thread layers, one of the three thread layers (for example, the middle thread layer) can be a wound using a polymeric thread that serves to bond all three thread layers together. In some embodiments, one or more thread layers of a thread pattern can be defined by a wound continuous thread coated or impregnated with an adhesive. In some embodiments, the adhesive can be activated with the application of heat. In some embodiments, the adhesive can be a dissolvable adhesive that, when contacted with a solvent, such as water, fully or partially dissolves to bond thread layers together.

Figure 3:
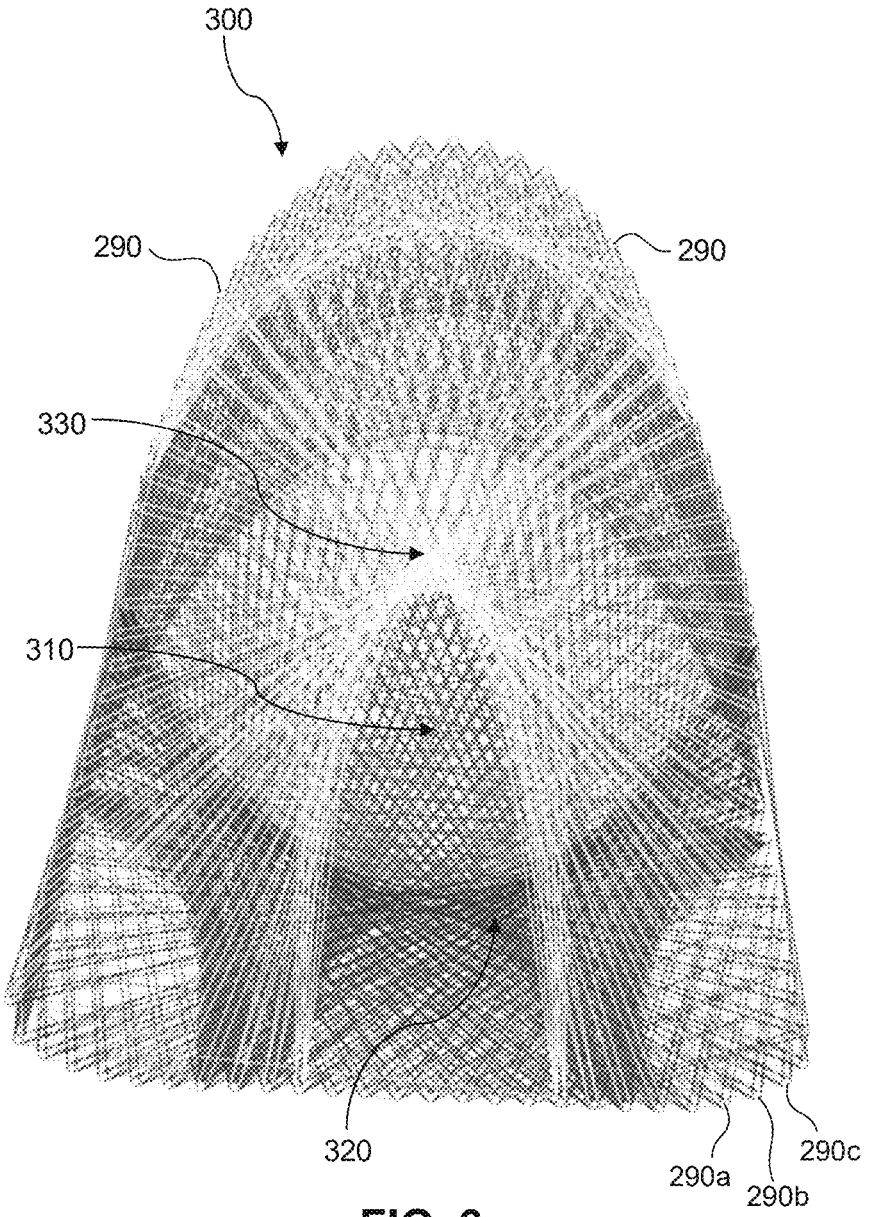
FIG. 3 shows a thread pattern according to some embodiments.

FIG. 3 illustrates a thread pattern 300 according to some embodiments. Thread pattern 300 can comprise multiple thread layers, for example, first thread layer 310, second thread layer 320, and third thread layer 330. Like thread layers 200, 220, and 240, thread layers 310, 320, 330 can each comprise a continuous thread wound around a plurality of anchor points 290. Thread pattern 300 can be a thread pattern produced using the apparatuses and methods described with respect to FIGS. 4-17. In some embodiments, first thread layer 310, second thread layer 320, and third thread layer 330 can each comprise a different continuous thread. In some embodiments, first thread layer 310, second thread layer 320, and third thread layer 330 can be wound sequentially. For example, first thread layer 310 can be wound around anchor points 290 first, followed by second thread layer 320 being wound around anchor points 290, and then third thread layer 330 being wound around anchor points 290. While FIG. 3 shows three thread layers 310, 320, 330, thread pattern 300 can comprise any number of thread layers, such as two, four, five, six, seven, eight, nine, ten, eleven, or twelve thread layers.

As shown in FIG. 3, each of first, second, and third thread layers 310, 320, 330 can be wound using different winding patterns (defined by the angles thread lines in a thread layer extend relative to a perimeter of the thread layer and relative to one another). The winding pattern(s) can be selected to influence a variety of characteristics of a resulting thread layer 310, 320, 330 or thread pattern 300, for example, durability, stiffness, weight, tackiness, texture, haptics, and/or air permeability.

Figure 4:
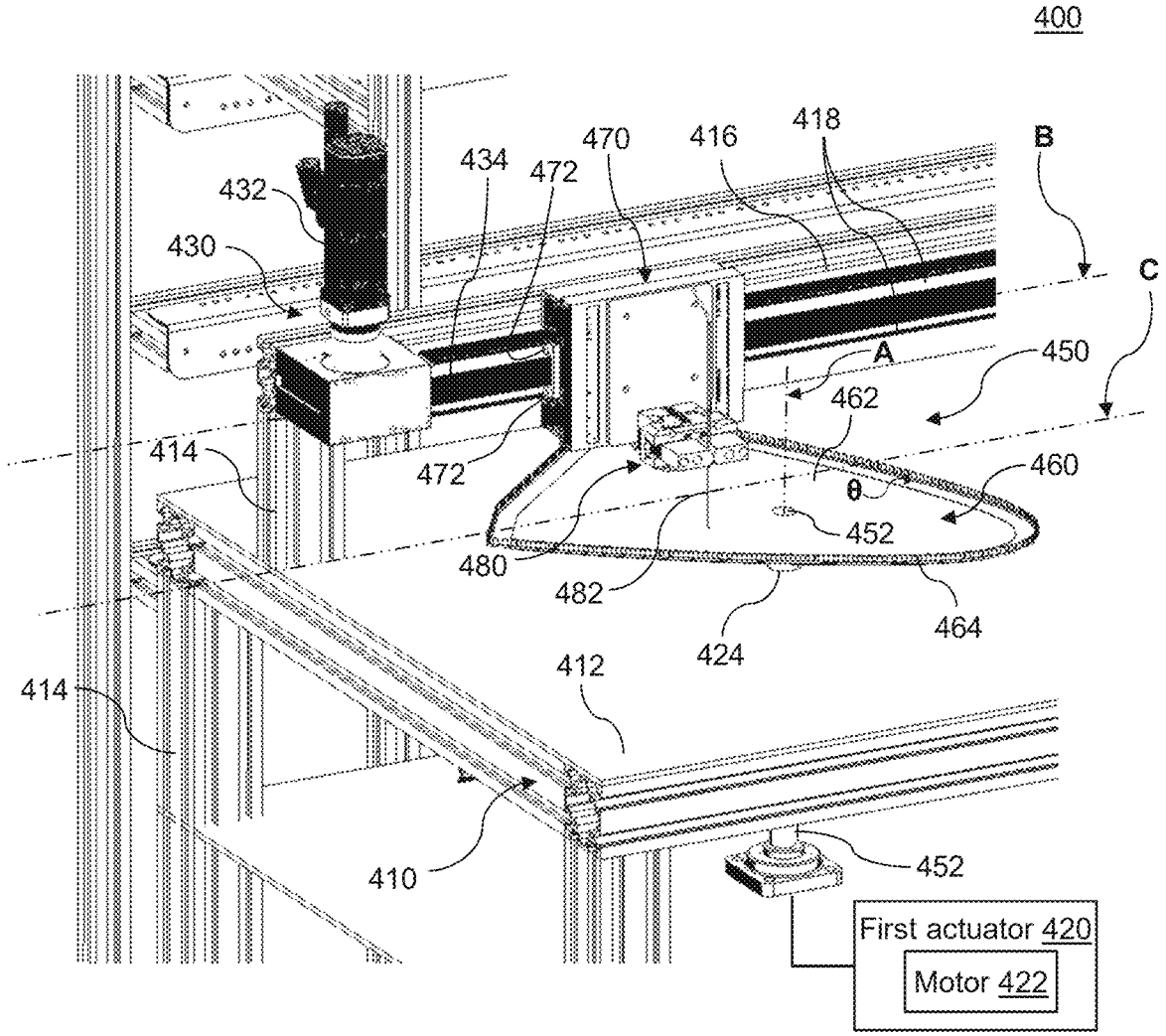
FIG. 4 shows an apparatus for producing thread layers according to some embodiments.

FIG. 4 illustrates a winding apparatus 400 for winding continuous thread(s) according to some embodiments. In some embodiments, winding apparatus 400 can be operated using computer numerical control (CNC), as described herein. In some embodiments, winding apparatus 400 can comprise a frame 410. In some embodiments, frame 410 can comprise a top surface 412 and supports 414. In some embodiments, frame 410, for example, supports 414, can support a bar 416. In some embodiments, bar 416 can comprise grooves 418. As discussed below, in some embodiments, a thread guide (for example, thread guide 480) can be movingly coupled via grooves 418 to bar 416 such that the thread guide can move parallel to bar 416. For example, thread guide 480 can be slidably coupled to bar 416 such that thread guide 480 can slide along bar 416.

Winding apparatus 400 can comprise one or more winding units 450. In some embodiments, winding unit 450 can comprise a shaft 452. In some embodiments, shaft 452 can be rotatable relative to frame 410 (for example, top surface 412). In some embodiments, winding unit 450 can comprise a plate 460. In some embodiments, plate 460 can comprise a base 462 and anchor points 464. Anchor points 464 can either be formed separately from base 462 and thereafter coupled to base 462 or can be integrally formed with base 462. In some embodiments, base 462 can be fixedly coupled to shaft 452 such that plate 460 is rotatable relative to frame 410.

As shown in FIG. 4, plate 460 can be rotatable on rotation axis A. In some embodiments, axis A can pass through a geometric center of shaft 452. In some embodiments, axis A can be perpendicular to a plane defined by base 462. In some embodiments, plate 460 can rotate counterclockwise. In some embodiments, plate 460 can rotate clockwise. In some embodiments, plate 460 can rotate both counterclockwise or clockwise on rotation axis A.

In some embodiments, rotation axis A can be substantially parallel to a gravity vector (i.e., a vector that points downward toward the center of the earth) during operation of winding apparatus 400. In some embodiments, rotation axis A can be substantially perpendicular to the gravity vector during operation of winding apparatus 400. In some embodiments, rotation axis A can be diagonal with respect to the gravity vector during operation of winding apparatus 400.

Anchor points 464 can be the same as anchor points 290 shown in FIG. 3. Anchor points 464 can be coupled to and extend from base 462. In some embodiments, anchor points 464 can extend from base 462 in a direction parallel to axis A. In some embodiments, anchor points 464 can extend beyond the perimeter of base 462 in a direction perpendicular to axis A. In some embodiments, anchor points 464 can additionally or alternatively extend beyond the perimeter of base 462 in a direction parallel to axis A (for example, they can extend diagonally from base 462). In some embodiments, anchor points 464 can be structures, for example, pins, projections, or nubs.

In some embodiments, winding unit 450 can comprise a coupling 470 to couple a thread guide (e.g., thread guide 480) to bar 416. In some embodiments, coupling 470 can comprise protrusions 472 which can engage with grooves 418 of bar 416. In some embodiments, protrusions 472 can movingly engage with grooves 418 such that protrusions can move or slide within grooves 418 and coupling 470 can move relative to bar 416 along a translation axis B. In some embodiments, translation axis B can be defined as an axis passing through bar 416 and along which coupling 470 can translate. In some embodiments, protrusions 470 can comprise wheels, balls, cylinders, or any other structure configured to roll or slide within grooves 418. Grooves 418 and protrusions 470 can minimize unwanted movements of thread guide 480 during winding of a continuous thread around anchor points 464 by securely coupling thread guide 480 to bar 416, while still allowing thread guide 480 to move relative to bar 416.

While sliding engagement of coupling 470 and bar 416 has been described above as being implemented using grooves 418 and protrusions 472, any coupling which allows thread guide 480 to move relative to bar 416 (for example, a rolling engagement) can be implemented in winding apparatus 400. Further, coupling 470 may comprise the grooves or other indents while bar 416 comprises the protrusions.

As shown in FIG. 4, winding unit 450 can comprise one or more thread guides 480 to guide a continuous thread while it is being wound around anchor points 464. In some embodiments, the one or more thread guides 480 can move laterally (i.e., over top surface 412). In some embodiments, thread guide 480 can comprise a tube, an eyelet, or other aperture through which a continuous thread can pass while being directed by thread guide 480. For example, in some embodiments, thread guide 480 can comprise one or more tubes 482 or other structure for passing the continuous thread between adjacent anchor points 464. A continuous thread can pass from a thread spool supported on frame 410 into tube 482 and exit tube 482 as thread guide 480 moves parallel to translation axis B along a thread guide translation axis C. Thread guide translation axis C can be defined as an axis parallel to translation axis B that passes through the point a continuous thread exits thread guide 480 as the continuous thread is wound around anchor points 464. In some embodiments, thread guide translation axis C can pass over shaft 452. In some embodiments, thread guide translation axis C can intersect axis A. In some embodiments, thread guide translation axis C can be laterally displaced from axis A. In some embodiments, thread guide translation axis C can be a lateral axis (i.e., an axis extending at a nonzero angle with respect to rotation axis A). In some embodiments, thread guide translation axis C can be perpendicular to rotation axis A.

In some embodiments, a portion of thread guide 480, for example tube 482 or an eyelet, or any other structure used to guide the continuous thread, is configured to pass between adjacent anchor points of anchor points 464 to wind the continuous thread around one of the adjacent anchor points 464. As used herein, a first anchor point described as "adjacent" to second anchor point means that the second anchor point is the first anchor point's first or second closest anchor point neighbor. An anchor point will typically have two "adjacent" anchor point neighbors, typically located on opposing sides of the anchor point. In embodiments comprising equally spaced anchor points, an anchor point's first and second closest anchor point neighbors may be located at the same distance from the anchor point. As an example, anchor points 290*a* and 290*c* are adjacent to anchor point 290*b* in FIG. 3. Anchor points 290*a* and 290*b* comprise a pair of adjacent anchor points and anchor points 290*b* and 290*c* comprise a pair of adjacent anchor points.

In some embodiments, multiple continuous threads can pass through thread guide 480 and be wound around an anchor point or anchor points 464 simultaneously. In such embodiments, thread guide 480 can comprise a single tube 482 or eyelet, or other structure used to guide a continuous thread, and multiple continuous threads can be passed through the tube or other structure. In some embodiments, thread guide 480 can comprise multiple tubes 482 or eyelets, or other structures that are configured to move in concert to pass between pairs of adjacent anchor points 464, and one or more continuous threads can be passed through each of the multiple tubes 482 or eyelets, or other structures. In some embodiments, passing multiple continuous threads through thread guide 480 and winding them simultaneously around anchor points 464 can increase the efficiency of winding apparatus 400.

As shown in FIG. 4, winding apparatus 400 can comprise a first actuator 420 configured to rotate shaft 452, and therefore plate 460. In some embodiments, first actuator 420 can comprise a motor 422. Additionally, in some embodiments, first actuator 420 can comprise one or more of a gear assembly, a belt and sheave, or a cable and pulley. In some embodiments, first actuator 420 can be coupled to shaft 452 to produce a torque on shaft 452 around axis A. The torque can rotate first shaft 452 and plate 460. In some embodiments, first actuator 420 can comprise a gear assembly between motor 422 and shaft 452 that can alter a gear ratio to either increase the precision or efficiency of rotations of plate 460. For example, in some embodiments, such a gear assembly can cause a full rotation of a shaft within motor 422 to produce less than a full rotation of shaft 452, which can increase precision in attaining a particular predetermined orientation of plate 460. In some embodiments, such a gear assembly can alternatively or additionally cause a full rotation of a shaft within motor 422 to produce more than a full rotation of shaft 452.

First actuator 420 can be coupled to a control system, which can vary the torque magnitude and/or direction of motor 422 to alter the angular velocity of plate 460 either while thread guide 480 is stationary or moving, as described herein in more detail.

As shown in FIG. 4, winding apparatus 400 can comprise a second actuator 430 configured to move thread guide 480 along thread guide translation axis C and between respective anchor points 464. In some embodiments, second actuator 430 can be an electromechanical linear actuator (for example, a motor coupled to a belt, chain, cable, or rack), a hydraulic linear actuator, or a pneumatic linear actuator. As shown in FIG. 4, in some embodiments, second actuator 430 can comprise a motor 432 and a flexible coupling 434 (e.g., a belt, chain, cable, or rack) coupled to motor 432 and extending along bar 416. In some embodiments, flexible coupling 434 can be coupled to coupling 470 such that activation of motor 432 moves a point on flexible coupling 434 and therefore moves coupling 470 along translation axis B. Like first actuator 420, second actuator 430 can be coupled to a control system, which can vary the torque magnitude and/or direction of motor 432 to alter the translation velocity of thread guide 480 either while plate 460 is stationary or rotating, as described herein in more detail. In embodiments in which second actuator 430 is a hydraulic or pneumatic linear actuator, the control system can vary the pressure of a liquid or gas to alter the translation velocity of thread guide 480.

In some embodiments, thread guide 480 may only move along an axis perpendicular to axis A (e.g., thread guide translation axis C) during winding of a continuous thread. For example, during winding, thread guide 480 can move along an axis perpendicular to axis A but not along any axis parallel to axis A. In some embodiments, coupling 470 and/or thread guide 480 can move thread guide 480 and/or tube 482 along an axis parallel to axis A. In such embodiments, movement of thread guide 480 and/or tube 482 along an axis parallel to axis A may only be needed to set thread guide 480 and/or tube 482 at an initial position prior to winding. In some embodiments, movement of thread guide 480 and/or tube 482 along an axis parallel to axis A may occur when thread guide 480 arrives at an anchor point 464 and serves to wrap the continuous thread around the anchor point 464.

In some embodiments, winding of a continuous thread around anchor points 464 may only require movement of thread guide 480 along a single axis, for example, thread guide translation axis C as described herein. For example, during winding of a continuous thread around anchor points 464, thread guide 480 may move only along thread guide translation axis C, which may remain constant and not be adjusted either laterally (away from or toward axis A) or longitudinally (parallel to axis A) during winding. Accordingly, winding apparatus 400 can complete a winding operation, for example, produce a thread layer, without moving thread guide 480 along multiple axes (after thread guide 480 has optionally been set to an initial position). In some embodiments, the single axis along which thread guide 480 moves during a winding operation can be perpendicular to axis A.

To accomplish winding of a continuous thread around anchor points 464, second actuator 430 can move coupling 470 such that thread guide 480 (for example, a component of thread guide 480 such as tube 482 or an eyelet) passes between adjacent anchor points of anchor points 464. Second actuator 430 can move coupling 470 such that thread guide 480 moves along thread guide translation axis C and between adjacent anchor points of anchor points 464. Thereafter or simultaneously, first actuator 420 can rotate plate 460. In some embodiments, without any movement parallel to axis A, thread guide 480 can pass between a first pair of adjacent anchor points (for example, anchor points 290*a* and 290*b* shown in FIG. 3), reverse direction, and pass between a second pair of adjacent anchor points (for example, anchor points 290*b* and 290*c*) either after plate 460 has rotated or while plate 460 is rotating. Accordingly, thread guide 480 can loop the continuous thread around an anchor point (for example, anchor point 290*b*).

After looping the continuous thread around a first anchor point (for example, anchor point 290*b*), coupling 470 can move thread guide 480 toward another pair of adjacent anchor points 464, either proximal or distal to the first anchor point. And after moving, the thread guide 480 can loop the continuous thread around a second anchor point of the other pair of adjacent anchor points 464 in the same manner as the first anchor point.

In some embodiments, anchor points 464 can extend at an angle relative to base 462. For example, a lengthwise axis of an anchor point 464 (for example, a projection) can extend outward from a perimeter of base 462 at an angle θ ranging from 90 degrees (°) to 180°, including subranges. For example, θ can range from 90° to 175°, 95° to 175°, from 100° to 175°, from 105° to 175°, from 110° to 175°, from 115° to 175°, from 120° to 175°, from 125° to 175°, from 130° to 175°, from 100° to 170°, from 115° to 160°, or from 125° to 145°. 0 can be measured between the lengthwise axis of an anchor point 464 and a line drawn from the geometric center of base 462 (for example, point $P_C$ in FIG. 6) to the anchor point 464.

When θ is less than 180°, no movement of thread guide 480 along multiple axes may be required to wind a continuous thread around an anchor point 464. This is because the continuous thread can catch on the anchor point 464 when thread guide 480 passes close to base 462, between adjacent anchor points 464, reverses direction, and passes between other adjacent anchor points 464 after plate 460 has rotated or while plate 460 is rotating. In some embodiments, for example, when θ is 180° or greater, coupling 470 and/or thread guide 480 can provide additional degrees of freedom for thread guide 480's and/or tube 482's movement such that thread guide 480 can still pass between the adjacent anchor points 464, for example, by moving along a first axis across plate 460 and along a second axis parallel to axis A to pass between adjacent anchor points 464.

In some embodiments, θ ranges from greater than 90° to less than 180°. In some embodiments, θ ranges from 95° to 175°. In some embodiments, θ can be selected such that a continuous thread is not likely to slip off an anchor point 464 after being wound. Additionally, θ can be selected such that an anchor point 464 projects from base 462 in a direction perpendicular to thread guide translation axis C a sufficient amount for thread guide 480 to pass—while moving only along thread guide translation axis C-through a region between base 462 and a line parallel to base 462 that touches an extreme tip of the anchor point 464. In some embodiments, an even larger value for 0, for example, from 120° to 175°, can be preferable to prevent a continuous thread that is being wound around an anchor point 464 from forcing off other portions of the continuous thread (or another continuous thread) that have been wound around the same anchor point 464.

In some embodiments, as noted above, winding apparatus 400 can comprise a control system for controlling first actuator 420 and second actuator 430. In some embodiments, the control system can comprise a computer system such as computer system 1800 shown in FIG. 18, though the control system need not comprise all components shown in FIG. 18. The control system can comprise a programmable memory (for example, main memory 1808 and/or second memory 1810). The programmable memory can store computer programs that can direct the rotation of plate 460 and movement of thread guide 480. For example, the programmable memory can store computer programs that instruct first actuator 420 and second actuator 430 to operate at certain conditions. In the case of first actuator 420, the conditions can comprise rate of rotation and direction of rotation. In the case of second actuator 430, the conditions can comprise rate of translation and direction of translation. The control system can set and alter the following conditions, alone or in combination with any other condition, to effect a desired winding pattern (defined by the angles thread lines in a wound thread layer extend with respect to the perimeter of the thread layer and with respect to other thread lines): i) rate of rotation of plate 460; ii) direction of rotation of plate 460; iii) rate of translation of thread guide 480; and iv) direction of translation of thread guide 480.

In some embodiments, these conditions can be set by a programmer of the control system specifying angular and linear positions (and/or angular and translation velocities) of plate 460 and thread guide 480, respectively, at various times or in various chronological orders. In some embodiments, the programmer can specify these angular and linear positions (and/or angular and translation velocities) in one or more files. In some embodiments, the one or more files can comprise a file describing the positions of anchor points 464 in three dimensions (3D). In such embodiments, each of anchor points 464 can be associated with a unique identifier (e.g., a number or alphanumeric code) that is specified in the file. In some embodiments, the one or more files can be JSON files, but the one or more files are not limited to a particular format. In some embodiments, one or more processors in the control system (for example, processor 1804) can interpret the contents of the one or more files into CNC G-code commands that control first and second actuators 420, 430 to move plate 460 and thread guide 480. In some embodiments, the contents of the one or more files can also comprise instructions to change a continuous thread to another continuous thread, for example, to transition between winding a first thread layer and winding a second thread layer.

The programmable memory may be preprogrammed with a series of instructions for effecting a single or a variety of winding patterns during the production of a thread layer. The control system can change the winding pattern during winding of the thread layer or thread pattern. The winding pattern(s) may be selected to influence a variety of characteristics of a resulting wound material (e.g., a thread layer or thread pattern), for example, durability, stiffness, weight, tackiness, texture, haptics, and/or air permeability.

Figure 5:
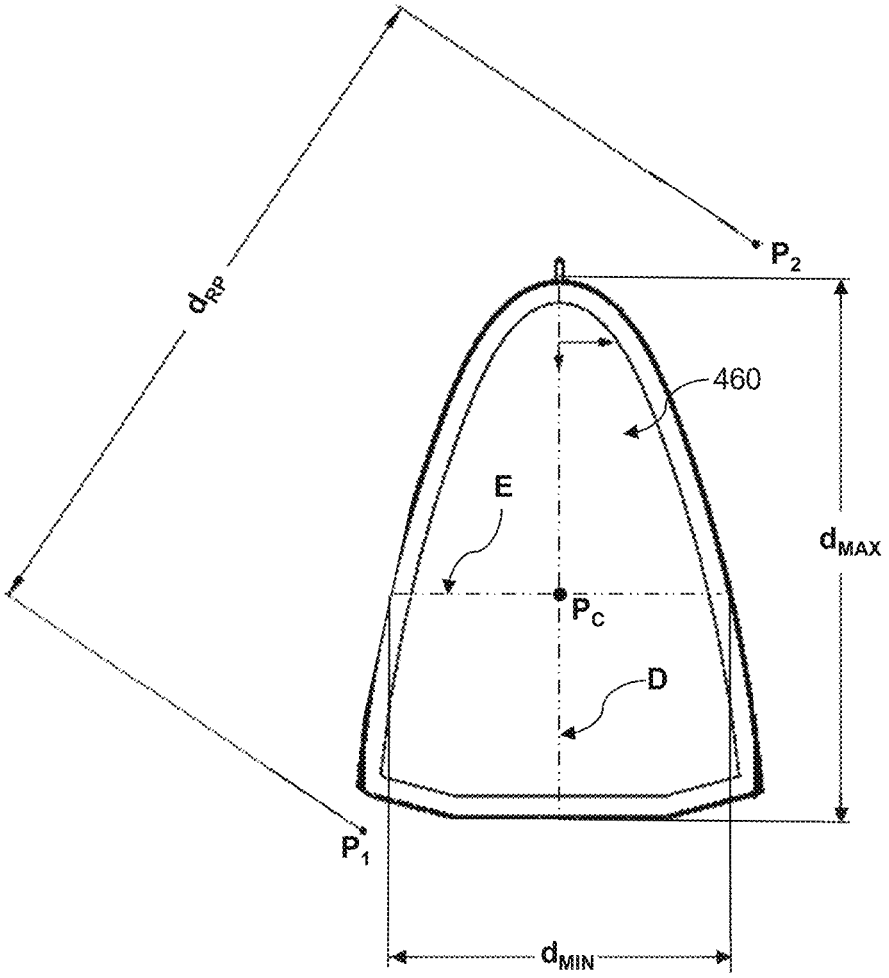
FIG. 5 shows a plate for winding thread layers according to some embodiments.

In some embodiments, values for angular velocity of plate 460 (which is a vector defining both rate and direction of rotation) and the translation velocity of thread guide 480 (which is a vector defining both rate and direction of translation) may be preprogrammed for various times or in various chronological orders throughout a winding operation. In some embodiments, values for orientation of plate 460 (as determined, for example, by an angle between a plate axis D as shown in FIG. 5 and axis B and/or C) and the translation position of thread guide 480 (as determined by the thread guide's position along axis B and/or C) may be preprogrammed for various times or in various chronological orders throughout a winding operation. In some embodiments, the programming of angular/translation velocities/orientations may be done by a programmer specifying the order in which the continuous thread should be wound around anchor points 464, for example, using the unique identifiers associated with anchor points 464. The distance between adjacent anchor points 464 and the dimensions of thread guide 480 (for example, the dimensions of the dispensing end of thread guide 480 that passes between adjacent anchor points 464 during winding) may also be accounted for by programing entry and exit vectors. Confining the movement of thread guide 480 as described herein can reduce the complexity of coupling 470 and/or thread guide 480. For example, in some embodiments, additional actuators to provide additional degrees of freedom for movement for thread guide 480 and/or tube 482 may not be required to wind the continuous thread around anchor points 464.

In some embodiments, one or more of these conditions can remain constant while a subset of these conditions are periodically changed. For example, the rate of rotation of plate 460 and the direction of rotation of plate 460 can remain constant, while the rate of translation of thread guide 480 can be changed to periodically reverse the translation direction of thread guide 480. In some embodiments, the direction of translation of thread guide 480 can be reversed at regular time intervals. In some embodiments, the direction of translation of thread guide 480 can be reversed at irregular time intervals. In some embodiments, thread guide 480 can pause for any time interval between reversals of translation direction.

In some embodiments, when changing rotation direction or pausing rotation of plate 460, the angular velocity of plate 460 can be varied smoothly. That is, plate 460 can gradually accelerate as it moves toward a midpoint of a movement (i.e., a motion segment between direction reversal points or stopping points) and gradually decelerate after it moves past the midpoint. Likewise, in some embodiments, when changing translation direction or pausing translation of thread guide 480, the velocity of thread guide 480 can be varied smoothly. That is, thread guide 480 can gradually accelerate as it moves toward a midpoint of a movement (i.e., a motion segment between direction reversal points or stopping points) and gradually decelerate after it moves past the midpoint. In some embodiments, varying the angular velocity of plate 460 and/or the translation velocity of thread guide 480 smoothly can minimize mechanical strain and deterioration of the components of first actuator 420 and second actuator 430.

In some embodiments, for example, in a "simultaneous mode," thread guide 480 can pass between pairs of adjacent anchor points 464 while plate 460 is rotating. For example, plate 460 can rotate continuously in a particular rotation direction while thread guide 480 passes between one or more pairs of adjacent anchor points 464. In the simultaneous mode, plate 460 may change rotation direction, but may not pause apart from executing changes in rotation direction.

In some embodiments, for example, in a "consecutive" or "partially consecutive" mode, thread guide 480 can pass between a pair of adjacent anchor points 464 while plate 460 is stationary. For example, thread guide 480 can pass between a pair of adjacent anchor points while plate 460 is stationary, plate 460 can rotate a predefined amount and stop, and thread guide 480 can pass between another pair of adjacent anchor points 464 while plate 460 is again stationary.

In some embodiments, for example, in the "consecutive mode," the movement of plate 460 and thread guide 480 can be consecutive. For example, thread guide 480 can pass between a pair of adjacent anchor points to a point beyond the perimeter of plate 460 while plate 460 is stationary, and stop; plate 460 can rotate a predefined amount and stop; and thread guide 480 can pass between another pair of adjacent anchor points 464 to a point inside the perimeter of plate 460 while plate 460 is stationary, and stop. Thread guide 480 can then remain at the point inside the perimeter of plate 460 while plate 460 rotates a predefined amount and stops, and thread guide 480 can pass between another pair of adjacent anchor points 464 to a point beyond the perimeter of plate 460 while plate 460 is stationary, and stop. Similar consecutive movements can be repeated to create a thread layer.

In some embodiments, for example, in the "partially consecutive mode," movement of plate 460 and thread guide 480 can be partially simultaneous and partially consecutive. For example, thread guide 480 can pass between a pair of adjacent anchor points to a point beyond the perimeter of plate 460 while plate 460 is stationary, plate 460 can rotate a predefined amount and stop, and thread guide 480 can pass between another pair of adjacent anchor points 464 to a point inside the perimeter of plate 460 while plate 460 is again stationary. Rather than remaining at the point inside the perimeter of plate 460 while plate 460 rotates, however, thread guide 480 can move across at least a portion of plate 460 while plate 460 rotates a predetermined amount and stops, and thread guide 480 can pass between another pair of adjacent anchor points 464 to a point beyond the perimeter of plate 460 while plate 460 is stationary. Similar partially consecutive and partially simultaneous movements can be repeated to create a thread layer.

In some embodiments, winding a thread layer can comprise winding the thread layer in the simultaneous mode. In some embodiments, winding a thread layer can comprise winding the thread layer in the consecutive mode. In some embodiments, winding a thread layer can comprise winding the thread layer in the partially consecutive mode. In some embodiments, winding a thread layer can comprise winding the thread layer in at least one of the simultaneous mode, the consecutive mode, the partially consecutive mode, or a combination thereof.

Winding apparatus 400 can comprise one or more thread spools for threading and winding thread lines of one or more thread layers around anchor points 464. In some embodiments, the thread spools can be stored on frame 410. In some embodiments, winding apparatus 400 can comprise a plurality of thread spools for threading and winding a plurality of different threads. Thread spools can be operatively coupled to one or more thread guides 480 such that thread guide 480 guides a continuous thread unwound from a thread spool during winding around anchor points 464 as described herein.

In some embodiments, winding apparatus 400 can comprise one or more thread tensioners configured to apply a desired tension to a continuous thread as it is wound around anchor points 464. In some embodiments, the control system controlling first and second actuators 420, 430 can control the one or more tensioners to wind the continuous thread at desired tensions. In some embodiments, thread spools and thread tensioners can be the same as or similar to those described in U.S. Pat. No. 11,602,196 B2, which is hereby incorporated by reference in its entirety.

In some embodiments, winding apparatus 400 can wind a plurality of threads from a plurality of thread spools simultaneously when winding a thread layer. In some embodiments, winding apparatus 400 can be used to simultaneously wind overlaying thread lines from a plurality of thread spools.

In some embodiments, winding apparatus 400 can comprise two or more thread guides 480 and/or second actuators 430 for winding a plurality of threads on a single plate 460 simultaneously. In such embodiments, the two or more thread guides 480 and/or second actuators 430 can wind different threads in different regions of a thread pattern simultaneously.

In some embodiments, winding apparatus 400 can ply two or more threads from different thread spools. In such embodiments, a thread layer or thread pattern can comprise one or more plied threads. As used herein, "plying" two or more threads means coupling the two or more threads together by twisting at least one of the two or more threads. In some embodiments, plying can comprise twisting one or more threads around one or more non-twisted threads. In some embodiments, plying can comprise twisting two or more threads together.

In some embodiments, a thread tensioner (for example, tensioning unit 2020) can be a mechanical tensioning device with digitally controlled impedance that is used to dynamically control how tight a thread is fed through thread guide 480. In some embodiments, the tension value for thread can be changed dynamically by adjusting the voltage in the tensioner. In some embodiments, the tensioner can be a manually adjustable tensioner. In some embodiments, the tensioner can comprise a spring configured to adjust the amount of tension applied to thread(s). The spring can be manually controlled or digitally controlled.

In some embodiments, the tension at which a continuous thread is wound can range from 0 centinewtons (cN) to 25 cN, including subranges. For example, in some embodiments, the tension can range from 0.01 cN to 25 cN, from 0.1 cN to 25 cN, from 1 cN to 25 cN, from 5 cN to 25 cN, from 10 cN to 25 cN, or from 15 cN to 25 cN. In some embodiments, the tension at which the continuous thread is wound can range from 2 cN to 10 cN. In some embodiments, the tension at which the continuous thread is wound can range from 2 cN to 6 cN.

In some embodiments, a first thread layer (for example, thread layer 200) can comprise a continuous thread (for example, continuous thread 202 of FIG. 2A) wound at a first tension and a second thread layer (for example, thread layer 220) disposed over the first thread layer can comprise a continuous thread (for example, continuous thread 222 of FIG. 2B) wound at a second tension greater than the first tension. In some embodiments, the second tension can be at least 0.5 cN greater than the first tension. In some embodiments, the second tension can be at least 1 cN greater than the first tension.

FIG. 5 illustrates plate 460 according to some embodiments. Plate 460 can be any suitable perimeter shape, for example, circular, oval, elliptical, triangular, rectangular, square, trapezoidal, pentagonal, hexagonal, octagonal, etc. Further, the perimeter shape of plate 460 can be any combination of shapes, for example, in some embodiments, oval in one region with triangular corners and a flat side in another region, as shown in FIG. 5.

In some embodiments, plate 460 can be substantially flat (i.e., the thread guide 480-facing surface of base 462 can be substantially flat). In some embodiments, the thread guide 480-facing surface of base 462 can be curved, for example, convexly curved, such that a continuous thread wound around anchor points 464 takes the shape of the surface. In such embodiments, thread guide 480 may move along multiple axes (for example thread guide translation axis C and an axis parallel to rotation axis A) to conform a continuous thread to the surface while winding the continuous thread. In some embodiments, the convex shape can help shape a resulting thread layer or thread pattern to fit a wearer's body when used in an article of apparel.

In some embodiments, base 462 can comprise a polymer. In some embodiments, base 462 can comprise a polymer composite such as a reinforced polymer. In some embodiments, base 462 can comprise a metal, for example aluminum or steel.

In some embodiments, plate 460 can have a longitudinal plate axis D and a latitudinal plate axis E. As illustrated in FIG. 5, longitudinal plate axis D can be defined as a line passing through a geometric center point $P_C$ of base 462, wherein the line is the longest such line traversing but not extending beyond base 462. Latitudinal plate axis E can be defined as a line passing through the geometric center point $P_C$ of base 462, wherein the line is the shortest such line traversing but not extending beyond base 462. In some embodiments, the geometric center point $P_C$ can be defined as the arithmetic mean position of all the points in the thread guide 480-facing surface of base 462. In some embodiments, latitudinal plate axis E can be perpendicular to longitudinal plate axis D (for example, when base 462 is symmetric about longitudinal plate axis D). In some embodiments, latitudinal plate axis E can be angled relative to longitudinal plate axis D.

Plate 460 can have a maximum diameter $d_{MAX}$. $d_{MAX}$ can be the length of longitudinal plate axis D. Likewise, plate 460 can have a minimum diameter $d_{MIN}$. $d_{MIN}$ can be the length of latitudinal plate axis E. In identifying $d_{MAX}$ and $d_{MIN}$, the thickness of base 462 along rotation axis A is not considered (i.e., cannot be the minimum diameter). Further, $d_{MAX}$ and $d_{MIN}$ can be measured when plate 460 is any shape, not just a circle, according to the definitions for longitudinal and latitudinal plate axes D and E discussed above.

In some embodiments, the ratio of $d_{MIN}$ to $d_{MAX}$ can range from 1:1 to 1:5, including subranges. For example, in some embodiments the ratio of $d_{MIN}$ to $d_{MAX}$ can range from 1:1 to 1:4.5, from 1:1 to 1:4, from 1:1 to 1:3.5, from 1:1 to 1:3, from 1:1 to 1:2.5, from 1:1 to 1:2, or from 1:1 to 1:1.5. In some embodiments, $d_{MIN}$ can be greater than or equal to half of $d_{MAX}$. In such embodiments, $d_{MIN}$ being greater than or equal to half of $d_{MAX}$ can minimize the distance thread guide 480 must travel, on average, to move between respective anchor points 464. In some embodiments, a circular or square plate 460 can be preferable to minimize the distance thread guide 480 must travel, on average, to move between respective anchor points 464.

In some embodiments, $d_{MIN}$ can range from 10 centimeters (cm) to 2 meters (m), including subranges. For example, $d_{MIN}$ can range from 10 cm to 1.75 m, from 10 cm to 1.5 m, from 10 cm to 1.25 m, from 15 cm to 1.25 cm, from 15 cm to 1 m, from 15 cm to 75 cm, from 20 cm to 75 cm, or from 20 cm to 50 cm. In some embodiments, $d_{MAX}$ can range from 10 centimeters (cm) to 3 meters (m), including subranges. For example, $d_{MAX}$ can range from 10 cm to 2.5 m, from 10 cm to 2 m, from 10 cm to 1.75 m, from 15 cm to 1.75 cm, from 15 cm to 1.5 m, from 15 cm to 1.25 m, from 20 cm to 1.25 m, from 20 cm to 1 m, from 20 cm to 75 cm, from 30 cm to 75 cm, from 40 cm to 75 cm, or from 50 cm to 75 cm.

Plate 460 can also have a rotation perimeter diameter $d_{RP}$. $d_{RP}$ can be the distance between two points, $P_1$ and $P_2$, which mark the farthest plate 460 will extend from rotation axis A while rotating. $P_1$ and $P_2$ and can be the same distance from rotation axis A, for example, the farthest distance plate 460 extends from rotation axis A while plate 460 is rotating. Further, $P_1$, $P_2$, and an intersection point of rotation axis A and plate 460 can form a single line.

In some embodiments, $d_{RP}$ can range from 10 cm to 6 m, including subranges. For example, in some embodiments, $d_{RP}$ can range from 10 cm to 5.5 m, from 10 cm to 5 m, from 10 cm to 4.5 m, from 15 cm to 4.5 m, from 15 cm to 4 m, from 15 cm to 3.5 m, from 20 cm to 3.5 m, from 20 cm to 3 m, from 20 cm to 2.5 m, from 30 cm to 2.5 m, from 30 cm to 2 m, from 30 cm to 1.5 m, from 40 cm to 1.5 m, from 40 cm to 1 m, from 40 cm to 75 cm, or from 50 cm to 75 cm.

In some embodiments, thread guide 480 can be movable along thread guide translation axis C between points that lie outside a circle whose boundary comprises points $P_1$ and $P_2$. Accordingly, thread guide 480 can be movable along thread guide translation axis C between points that lie outside the perimeter of plate 460 regardless of an orientation of plate 460 during winding of a continuous thread around anchor points 464.

In some embodiments, shaft 452 can be coupled to base 462 adjacent a center of mass of plate 460. In such embodiments, rotation axis A can pass through or adjacent to the center of mass of plate 460. In such embodiments, shaft 452 being coupled to base 462 adjacent the center of mass of plate 460 can reduce mechanical imbalance as plate 460 is rotated, therefore causing less strain on shaft 452 and/or components of first actuator 420.

In some embodiments, shaft 452 can be coupled to base 462 adjacent center point $P_C$. In such embodiments, rotation axis A can pass through or adjacent to center point $P_C$. In some of such embodiments, for example, when the thickness along rotation axis A of base 462 is substantially evenly distributed across base 462, the center of mass of plate 460 can be substantially aligned, in the view of FIG. 5, with center point $P_C$. Accordingly, shaft 452 can be coupled to base 462 adjacent both the center of mass of plate 460 and adjacent center point $P_C$. As used in the context of the coupling of shaft 452 to base 462, "adjacent" the center of mass or "adjacent" center point $P_C$ can mean within one-eighth of $d_{MAX}$ from the center of mass or from $P_C$.

Figure 6:
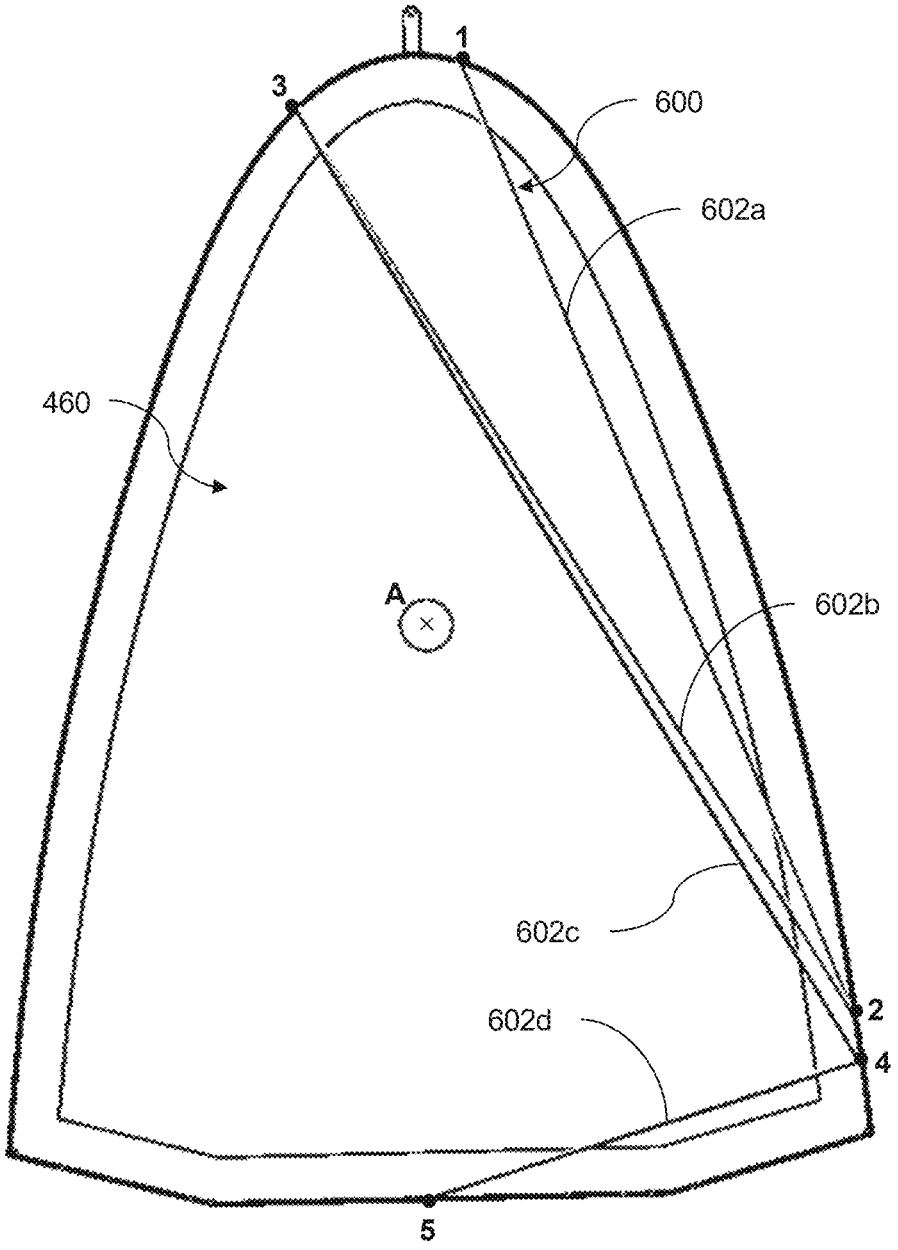
FIG. 6 shows the plate of FIG. 5 and thread lines according to some embodiments.

FIG. 6 illustrates a plurality of thread lines 602 of a continuous thread 600 extending between respective anchor points according to some embodiments. For ease of illustrating the order thread guide 480 travels around each of these anchor points as shown in FIGS. 7A-14B, the anchor points are labeled 1, 2, 3, 4, and 5; but anchor points 1-5 can be the same as anchor points 464. Further, while FIGS. 7A-14B show thread guide 480 traveling around anchor points 1-5 in sequence, thread guide 480 can travel around anchor points 1-5 in reverse sequence, for example, starting at anchor point 5.

FIG. 6 illustrates a first thread line 602*a*, a second thread line 602*b*, a third thread line 602*c*, and a fourth thread line 602*d*. As shown in FIG. 6, first thread line 602*a* extends between anchor points 1 and 2, second thread line 602*b* extends between anchor points 2 and 3, third thread line 602*c* extends between anchor points 3 and 4, and fourth thread line 602*d* extends between anchor points 4 and 5. First, second, third, and fourth thread lines 602*a-d* can be portions of a continuous thread 600, which can be the same as continuous thread 202, 222, or 242. Each of first, second, third, and fourth thread lines 602*a-d* can have a length.

FIGS. 7A-14B illustrate the process of winding continuous thread 600 around anchor points 1-5 to produce first, second, third, and fourth thread lines 602*a-d* according to some embodiments. While all of first, second, third, and fourth thread lines 602*a-d* are shown (but not labeled) in FIGS. 7A-14B for ease of illustration, it should be understood that only the labeled thread line (for example, first thread line 602*a* in FIG. 7B) is being or has been wound around anchor points at the stages depicted in FIGS. 7B, 8B, 9B, 10B, 11B, 12B, 13B, and 14B.

Figure 7A:
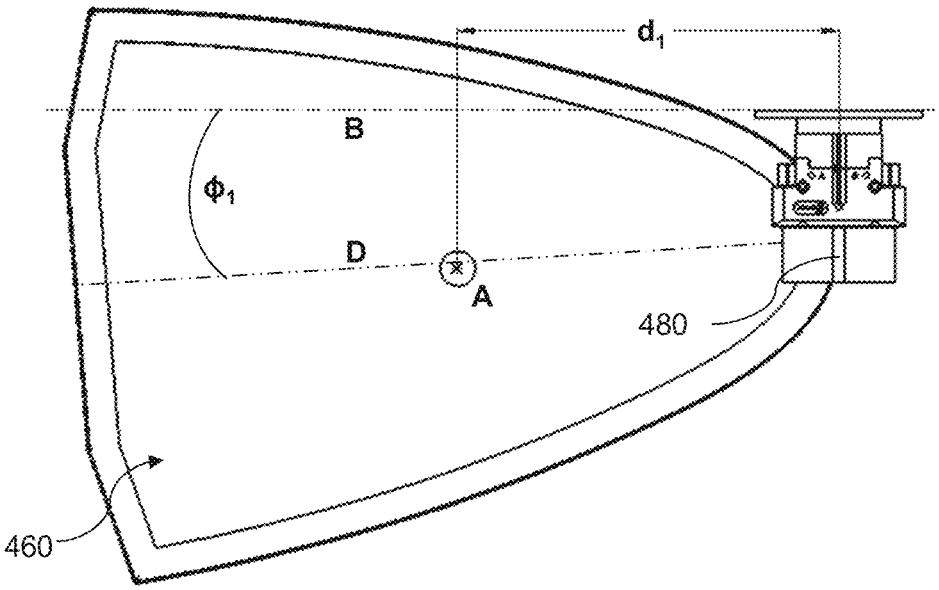
FIGS. 7A-7B show the plate of FIG. 5 and a thread guide starting a thread line, according to some embodiments.
Figure 7B:
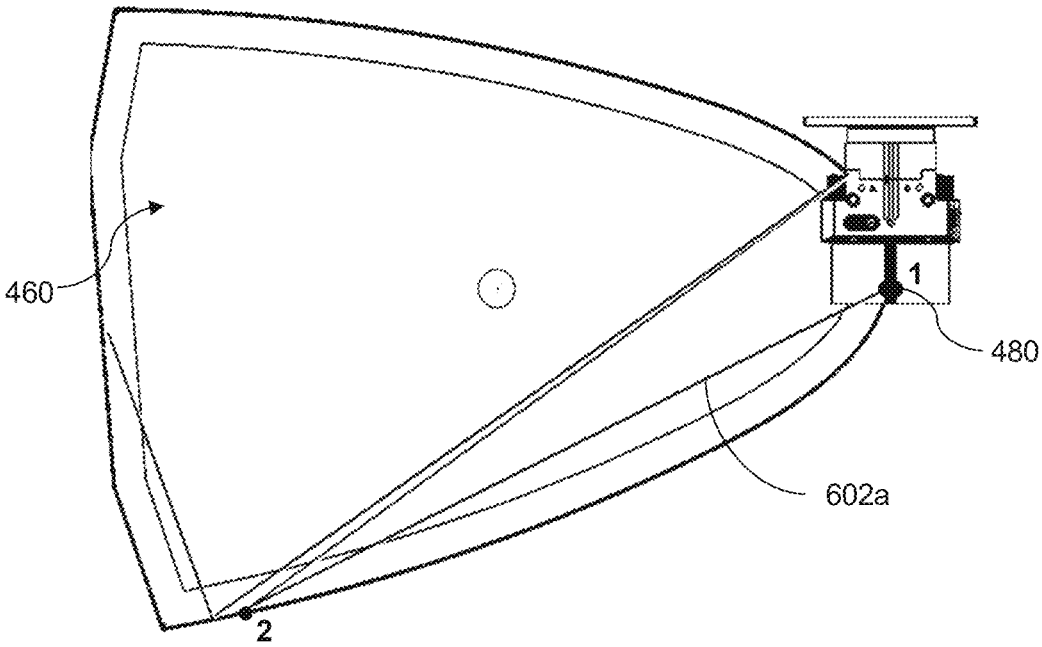

FIGS. 7A-7B illustrate the position of thread guide 480 and orientation of plate 460 when thread guide 480 is winding continuous thread 600 around anchor point 1. The orientation of plate 460 when thread guide 480 is winding continuous thread 600 around anchor point 1 can be quantified by the angle 1 between longitudinal plate axis D and translation axis B. Though the angle between longitudinal plate axis D and translation axis B can be used to quantify the orientation of plate 460, any axis of plate 460 and any axis parallel to or set relative to translation axis B (for example, thread guide translation axis C) can be used to quantify the orientation of plate 460. The position of thread guide 480 when thread guide 480 is winding continuous thread 600 around anchor point 1 can quantified by the distance $d_1$ between rotation axis A and thread guide 480 (for example, the point continuous thread 600 exits thread guide 480). $d_1$ can represent the farthest distance thread guide 480 must travel from rotation axis A, while being confined to a single axis, to wind continuous thread 600 around anchor point 1.

Figure 8A:
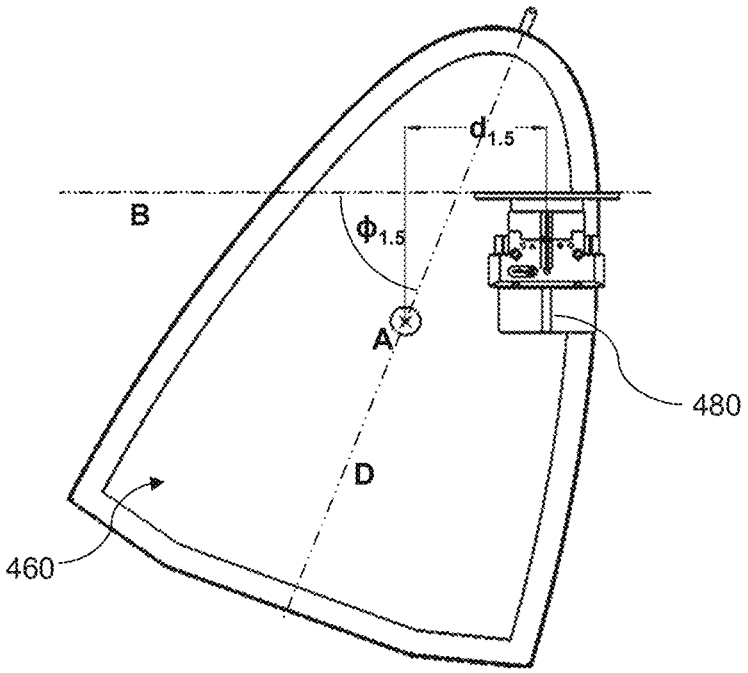
FIGS. 8A-8B show the plate of FIG. 5 and the thread guide of FIGS. 7A-7B continuing the thread line of FIGS. 7A-7B, according to some embodiments.
Figure 8B:
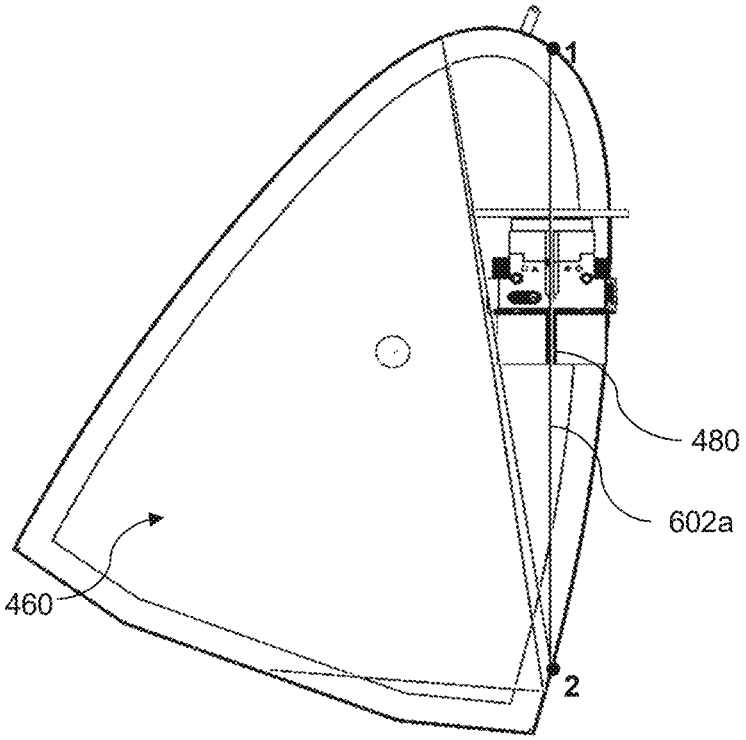

FIGS. 8A-8B illustrate the position of thread guide 480 and orientation of plate 460 when thread guide 480 is between anchor point 1 and anchor point 2. The orientation of plate 460 when thread guide 480 is between anchor point 1 and anchor point 2 can be quantified by the angle $\phi_{1.5}$ between longitudinal plate axis D and translation axis B. The position of thread guide 480 when thread guide 480 is between anchor point 1 and anchor point 2 can be quantified by the distance $d_{1.5}$ between rotation axis A and thread guide 480 (for example, the point continuous thread 600 exits thread guide 480). $d_{1.5}$ can represent the closest distance thread guide 480 must travel from rotation axis A, while being confined to a single axis, to move continuous thread 600 between anchor point 1 and anchor point 2.

Between FIGS. 7A-7B and FIGS. 8A-8B, plate 460 can rotate (for example, counterclockwise) an angle $\phi_{1.5}$-$\phi_1$ and thread guide 480 can travel a distance $d_1$-$d_{1.5}$.

Figure 9A:
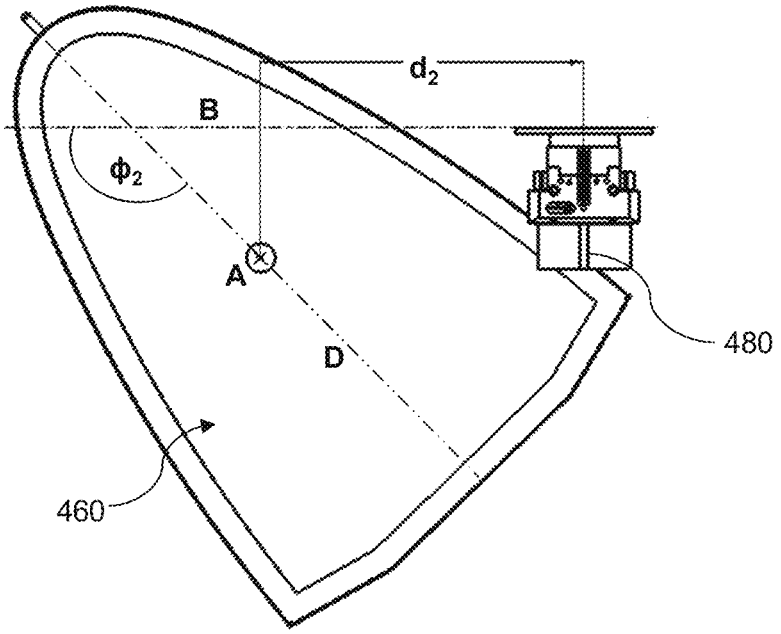
FIGS. 9A-9B show the plate of FIG. 5 and the thread guide of FIGS. 7A-7B completing the thread line of FIGS. 7A-7B and starting a second thread line, according to some embodiments.
Figure 9B:
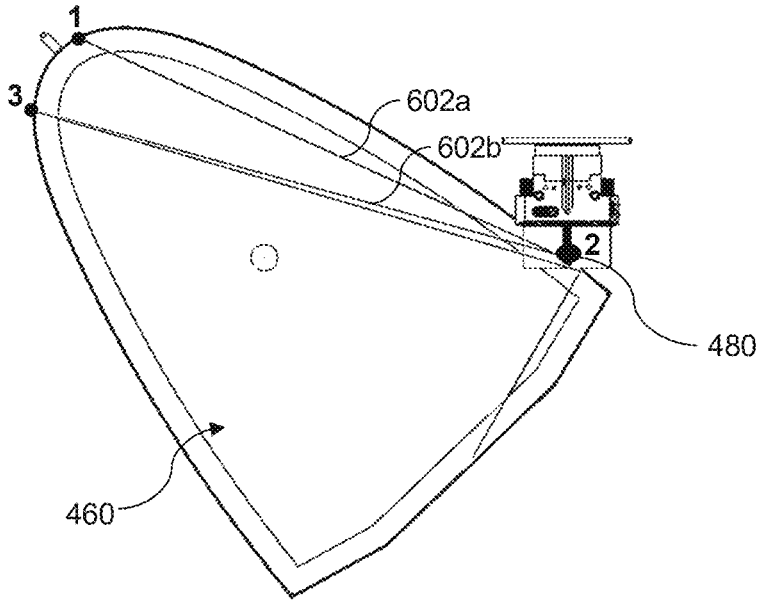

FIGS. 9A-9B illustrate the position of thread guide 480 and orientation of plate 460 when thread guide 480 is winding continuous thread 600 around anchor point 2 to complete first thread line 602*a* and start second thread line 602*b*. The orientation of plate 460 when thread guide 480 is winding continuous thread 600 around anchor point 2 can be quantified by the angle $\phi_2$ between longitudinal plate axis D and translation axis B. The position of thread guide 480 when thread guide 480 is winding continuous thread 600 around anchor point 2 can quantified by the distance $d_2$ between rotation axis A and thread guide 480 (for example, the point continuous thread 600 exits thread guide 480). $d_2$ can represent the farthest distance thread guide 480 must travel from rotation axis A, while being confined to a single axis, to wind continuous thread 600 around anchor point 2.

Between FIGS. 8A-8B and FIGS. 9A-9B, plate 460 can rotate (for example, counterclockwise) an angle $\phi_2$-$\phi_{1.5}$ and thread guide 480 can travel a distance $d_2$-$d_{1.5}$.

Figure 10A:
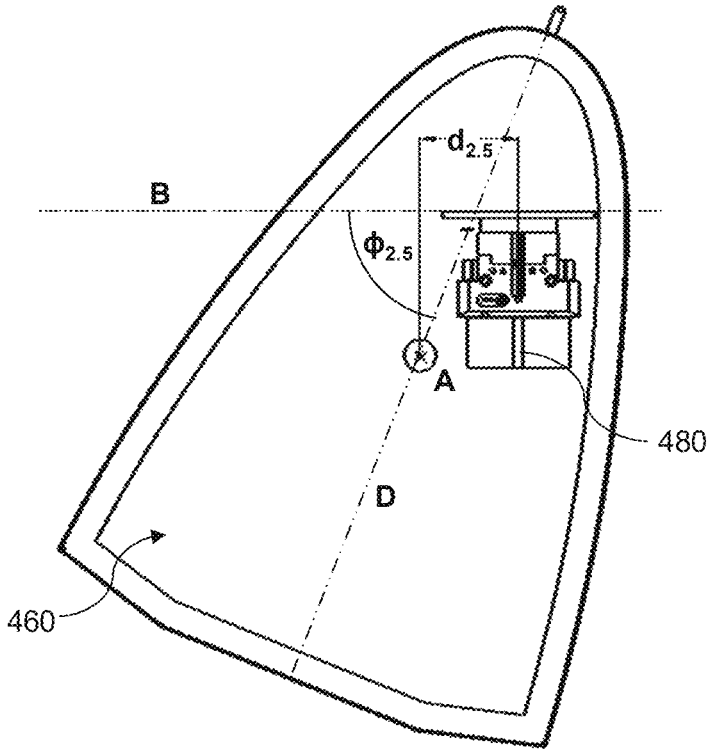
FIGS. 10A-10B show the plate of FIG. 5 and the thread guide of FIGS. 7A-7B continuing the second thread line of FIGS. 9A-9B, according to some embodiments.
Figure 10B:
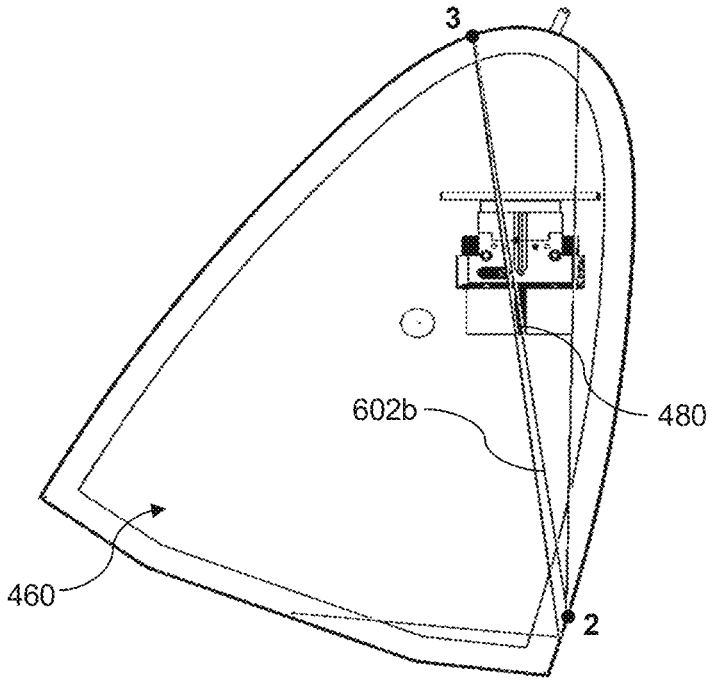

FIGS. 10A-10B illustrate the position of thread guide 480 and orientation of plate 460 when thread guide 480 is between anchor point 2 and anchor point 3. The orientation of plate 460 when thread guide 480 is between anchor point 2 and anchor point 3 can be quantified by the angle $\phi_{2.5}$ between longitudinal plate axis D and translation axis B. The position of thread guide 480 when thread guide 480 is between anchor point 2 and anchor point 3 can be quantified by the distance $d_{2.5}$ between rotation axis A and thread guide 480 (for example, the point continuous thread 600 exits thread guide 480). $d_{2.5}$ can represent the closest distance thread guide 480 must travel from rotation axis A, while being confined to a single axis, to move continuous thread 600 between anchor point 2 and anchor point 3.

Between FIGS. 9A-9B and FIGS. 10A-10B, plate 460 can rotate (for example, clockwise) an angle $\phi_2$-$\phi_{2.5}$ and thread guide 480 can travel a distance $d_2$-$d_{2.5}$. After continuous thread 600 has been wrapped around anchor point 2, plate 460 can rotate either clockwise or counterclockwise to reach the orientation shown in FIGS. 10A-10B. However, in some embodiments, it can be more efficient for plate 460 to reverse direction and rotate clockwise to reach the orientation shown in FIGS. 10A-10B. Accordingly, winding apparatus 400 can be configured to rotate plate 460 a maximally efficient direction (i.e., the direction requiring the least rotation) to wind continuous thread 600 around a preselected anchor point (e.g., anchor point 3).

Figure 11A:
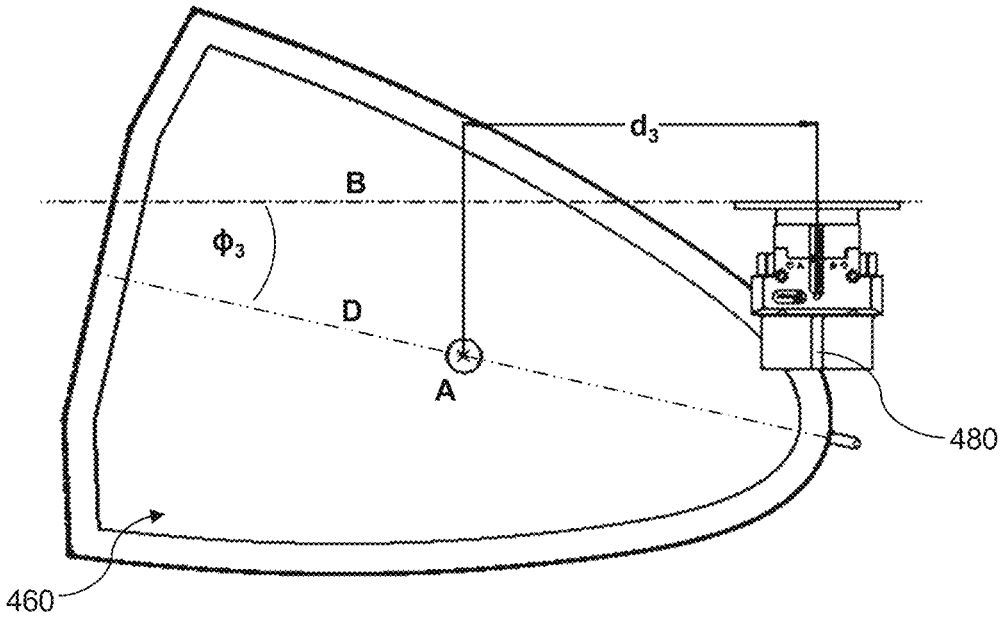
FIGS. 11A-11B show the plate of FIG. 5 and the thread guide of FIGS. 7A-7B completing the second thread line of FIGS. 9A-9B and starting a third thread line, according to some embodiments.
Figure 11B:
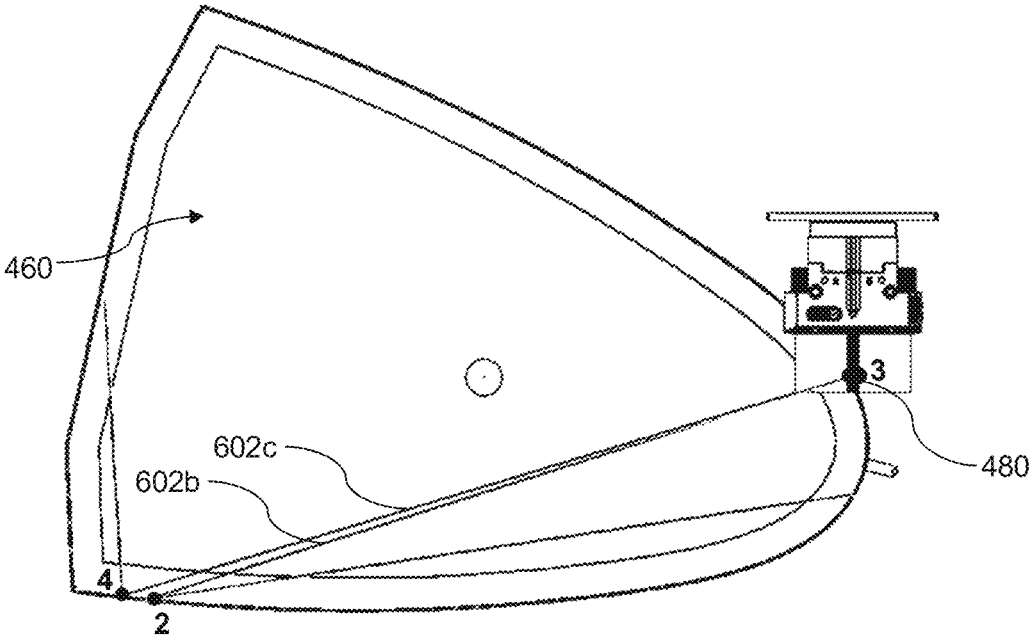

FIGS. 11A-11B illustrate the position of thread guide 480 and orientation of plate 460 when thread guide 480 is winding continuous thread 600 around anchor point 3 to complete second thread line 602*b* and start third thread line 602*c*. The orientation of plate 460 when thread guide 480 is winding continuous thread 600 around anchor point 3 can be quantified by the angle $\phi_3$ between longitudinal plate axis D and translation axis B. The position of thread guide 480 when thread guide 480 is winding continuous thread 600 around anchor point 3 can quantified by the distance $d_3$ between rotation axis A and thread guide 480 (for example, the point continuous thread 600 exits thread guide 480). $d_3$ can represent the farthest distance thread guide 480 must travel from rotation axis A, while being confined to a single axis, to wind continuous thread 600 around anchor point 3.

Between FIGS. 10A-10B and FIGS. 11A-11B, plate 460 can rotate (for example, clockwise) an angle $\phi_{2.5}$+$\phi_3$ and thread guide 480 can travel a distance $d_3$-$d_{2.5}$.

Figure 12A:
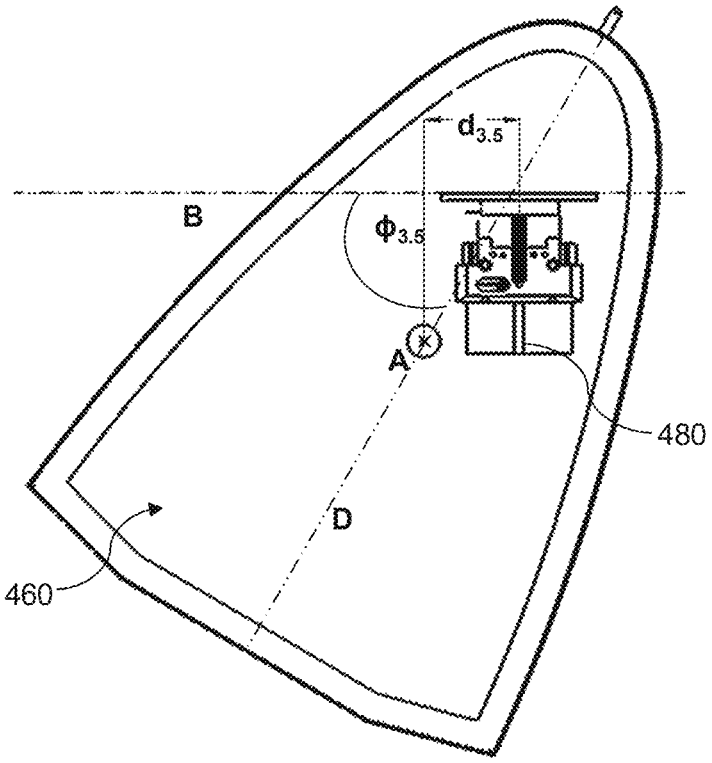
FIGS. 12A-12B show the plate of FIG. 5 and the thread guide of FIGS. 7A-7B continuing the third thread line of FIGS. 11A-11B, according to some embodiments.
Figure 12B:
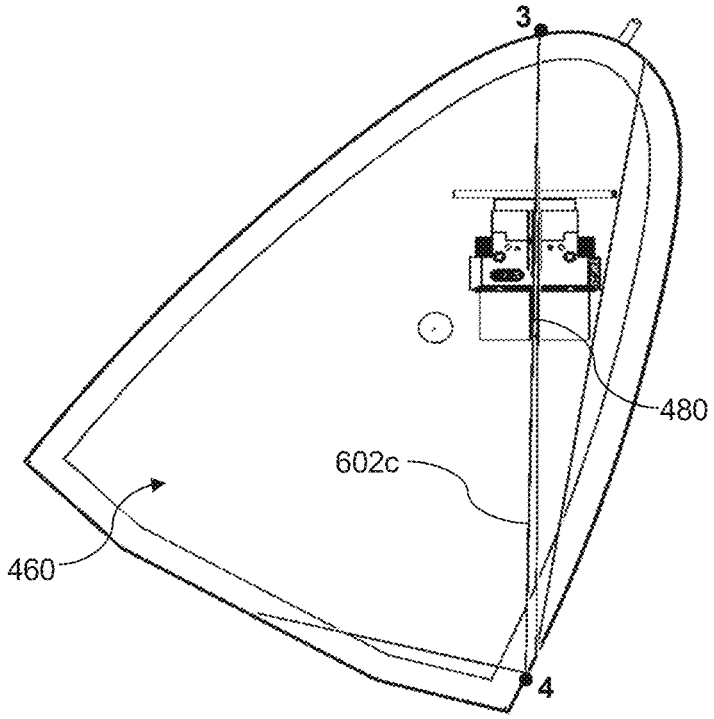

FIGS. 12A-12B illustrate the position of thread guide 480 and orientation of plate 460 when thread guide 480 is between anchor point 3 and anchor point 4. The orientation of plate 460 when thread guide 480 is half way between anchor point 3 and anchor point 4 can be quantified by the angle $\phi_{3.5}$ between longitudinal plate axis D and translation axis B. The position of thread guide 480 when thread guide 480 is half way between anchor point 3 and anchor point 4 can be quantified by the distance $d_{3.5}$ between rotation axis A and thread guide 480 (for example, the point continuous thread 600 exits thread guide 480). $d_{3.5}$ can represent the closest distance thread guide 480 must travel from rotation axis A, while being confined to a single axis, to move continuous thread 600 between anchor point 3 and anchor point 4.

Between FIGS. 11A-11B and FIGS. 12A-12B, plate 460 can rotate (for example, counterclockwise) an angle $\phi_3$+$\phi_{3.5}$ and thread guide 480 can travel a distance $d_3$-$d_{3.5}$.

Figure 13A:
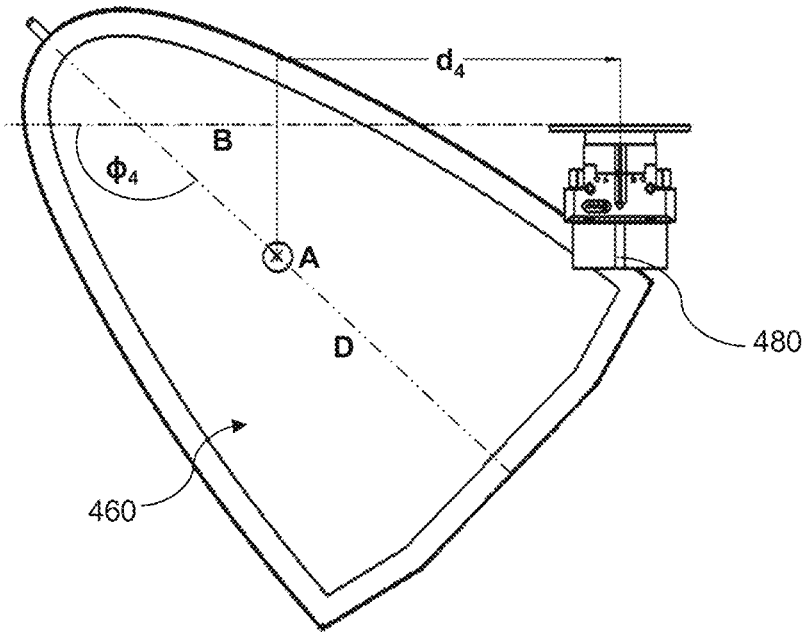
FIGS. 13A-13B show the plate of FIG. 5 and the thread guide of FIGS. 7A-7B completing the third thread line of FIGS. 11A-11B and starting a fourth thread line, according to some embodiments.
Figure 13B:
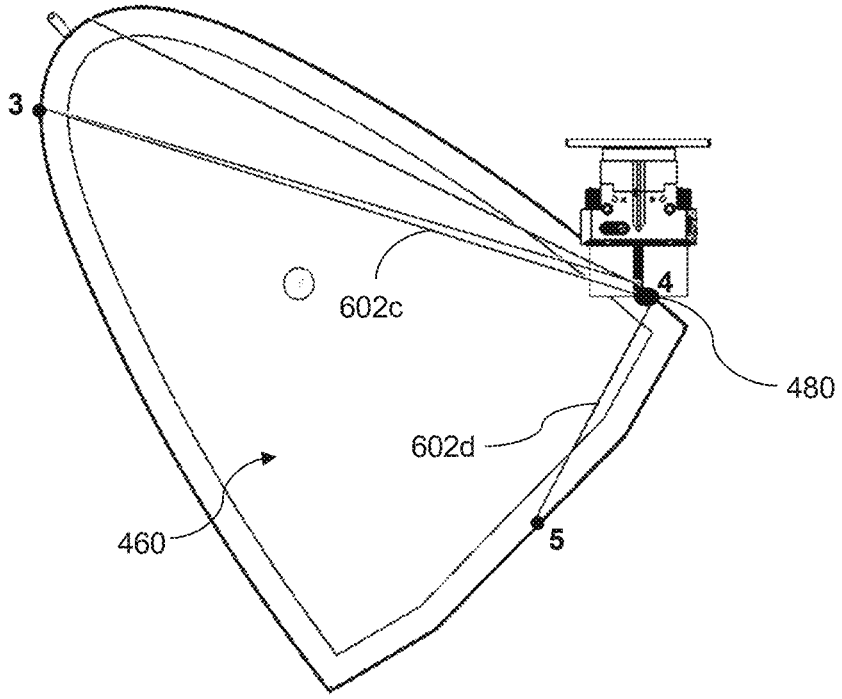

FIGS. 13A-13B illustrate the position of thread guide 480 and orientation of plate 460 when thread guide 480 is winding continuous thread 600 around anchor point 4 to complete third thread line 602*c* and start fourth thread line 602*d*. The orientation of plate 460 when thread guide 480 is winding continuous thread 600 around anchor point 4 can be quantified by the angle $\phi_4$ between longitudinal plate axis D and translation axis B. The position of thread guide 480 when thread guide 480 is winding continuous thread 600 around anchor point 4 can quantified by the distance $d_4$ between rotation axis A and thread guide 480 (for example, the point continuous thread 600 exits thread guide 480). $d_4$ can represent the farthest distance thread guide 480 must travel from rotation axis A, while being confined to a single axis, to wind continuous thread 600 around anchor point 4.

Between FIGS. 12A-12B and FIGS. 13A-13B, plate 460 can rotate (for example, counterclockwise) an angle $\phi_4$-$\phi_{3.5}$ and thread guide 480 can travel a distance $d_4$-$d_{3.5}$.

Figure 14A:
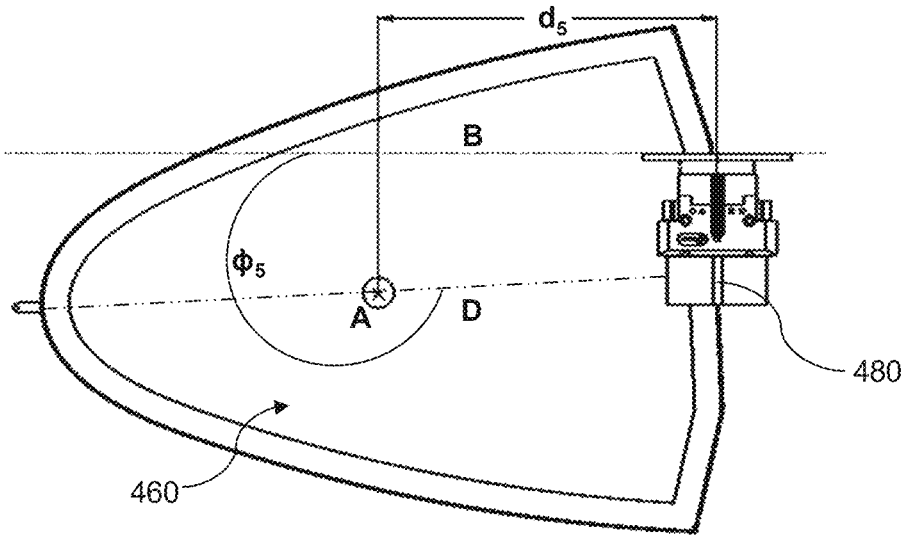
FIGS. 14A-14B show the plate of FIG. 5 and the thread guide of FIGS. 7A-7B completing the fourth thread line of FIGS. 13A-13B, according to some embodiments.
Figure 14B:
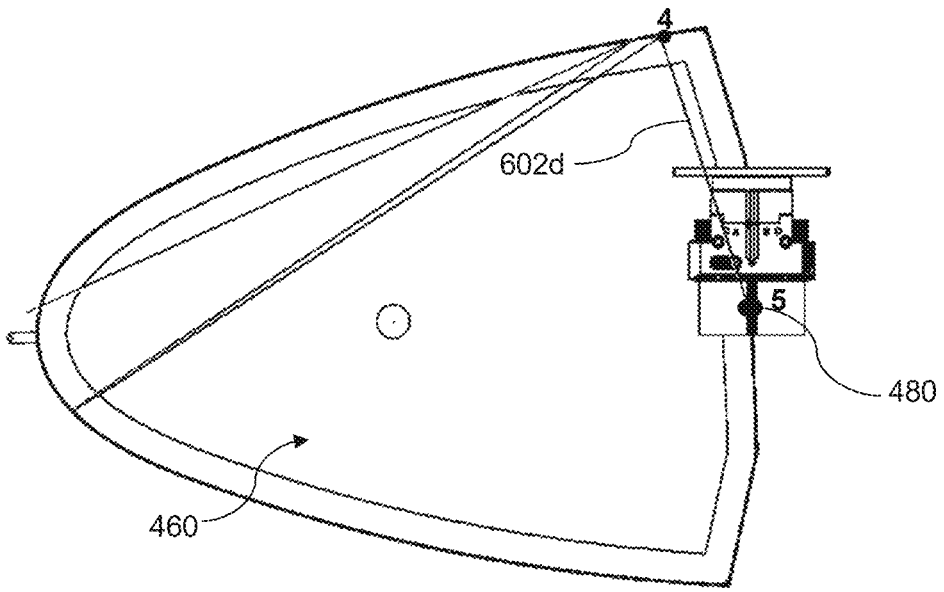

FIGS. 14A-14B illustrate the position of thread guide 480 and orientation of plate 460 when thread guide 480 is winding continuous thread 600 around anchor point 5 to complete fourth thread line 602*d*. The orientation of plate 460 when thread guide 480 is winding continuous thread 600 around anchor point 5 can be quantified by the angle $\phi_5$ between longitudinal plate axis D and translation axis B. The position of thread guide 480 when thread guide 480 is winding continuous thread 600 around anchor point 5 can quantified by the distance $d_5$ between rotation axis A and thread guide 480 (for example, the point continuous thread 600 exits thread guide 480). $d_5$ can represent the farthest distance thread guide 480 must travel from rotation axis A, while being confined to a single axis, to wind continuous thread 600 around anchor point 5.

Between FIGS. 13A-13B and FIGS. 14A-14B, plate 460 can rotate (for example, counterclockwise) an angle $\phi_5$-$\phi_4$ thread guide 480 and can travel a distance $d_4$-$d_5$.

While FIGS. 7A-14B show winding apparatus 400 winding four thread lines 602*a-d*, FIGS. 7A-14B are illustrative of the process for winding any number of thread lines 602 on plate 460, for example, the number of thread lines in a thread layer.

FIG. 15 shows a table of distances traveled by thread guide 480 in comparison to the lengths of first, second, third, and fourth thread guides 602*a-d*. The distance traveled by thread guide 480 when winding first thread line 602*a* can be $(d_1-d_{1.5})+(d_2-d_{1.5})$. In some embodiments, $(d_1-d_{1.5})+(d_2-d_{1.5})$ can be less than the length of first thread line 602*a*. For example, in some embodiments, $(d_1-d_{1.5})+(d_2-d_{1.5})$ can be less than or equal to two-thirds of the length of first thread line 602*a*.

The distance traveled by thread guide 480 when winding second thread line 602*b* can be $(d_2-d_{2.5})+(d_3-d_{2.5})$. In some embodiments, $(d_2-d_{2.5})+(d_3-d_{2.5})$ can be less than the length of second thread line 602*b*. For example, in some embodiments, $(d_2-d_{2.5})+(d_3-d_{2.5})$ can be less than or equal to four-fifths of the length of second thread line 602*b*.

The distance traveled by thread guide 480 when winding third thread line 602*c* can be $(d_3-d_{3.5})+(d_4-d_{3.5})$. In some embodiments, $(d_3-d_{3.5})+(d_4-d_{3.5})$ can be less than the length of third thread line 602*c*. For example, in some embodiments, $(d_3-d_{3.5})+(d_4-d_{3.5})$ can be less than or equal to four-fifths of the length of third thread line 602*c*.

The distance traveled by thread guide 480 when winding fourth thread line 602*d* can be $d_4$-$d_5$. In some embodiments, $d_4$-$d_5$ can be less than the length of fourth thread line 602*d*. For example, in some embodiments, $d_4$-$d_5$ can be less than or equal to one-tenth of the length of fourth thread line 602*d*.

The distance traveled by thread guide 480 when winding all of first, second, third, and fourth thread lines 602*a-d* can be $d_1-2d_{1.5}+2d_2-2d_{2.5}+2\ d_3-2d_{3.5}+2d_4-d_5$. In some embodiments, $d_1-2d_{1.5}+2d_2-2d_{2.5}+2\ d_3-2d_{3.5}+2d_4-d_5$ can be less than the combined lengths of first, second, third, and fourth thread lines 602*a-d*. For example, in some embodiments, $d_1-2d_{1.5}+2\ d_2-2d_{2.5}+2\ d_3-2d_{3.5}+2\ d_4-d_5$ can be less than or equal to eleven-twelfths of the combined lengths of first, second, third, and fourth thread lines 602*a-d*, including subranges. For example, in come embodiments, $d_1-2d_{1.5}+2d_2-2d_{2.5}+2d_3-2d_{3.5}+2d_4-d_5$ can be less than or equal to five-sixths of the combined lengths of first, second, third, and fourth thread lines 602*a-d*, less than or equal to three-fourths of the combined lengths of first, second, third, and fourth thread lines 602*a-d*, or less than or equal to two-thirds of the combined lengths of first, second, third, and fourth thread lines 602*a-d*.

Therefore, winding apparatus 400 can wind a length of continuous thread 600 that is greater than a distance traveled by thread guide 480 during winding of the length of continuous thread 600. Accordingly, rotation of plate 460 underneath thread guide 480 can reduce the amount of translation required by thread guide 480 as compared to an apparatus that comprises a stationary plate 460 and a thread guide 480 that moves on multiple axes. This can make winding of continuous thread 600 to produce a thread layer more time efficient, as thread guide 480 travels shorter distances. Further, since rotation of plate 460 can be more energy efficient than translation of thread guide 480, the configuration of a rotatable plate 460 and a translating thread guide 480 can lead to reduced power consumption and production costs. Rotation of plate 460 can be more energy efficient than translation of thread guide 480 since, in some embodiments, one or less rotations of motor 422 can produce a complete rotation of plate 460, as described above, while more rotations of motor 432 may be required to move thread guide 480, via flexible coupling 434, across a full diameter of plate 460.

Figure 16:
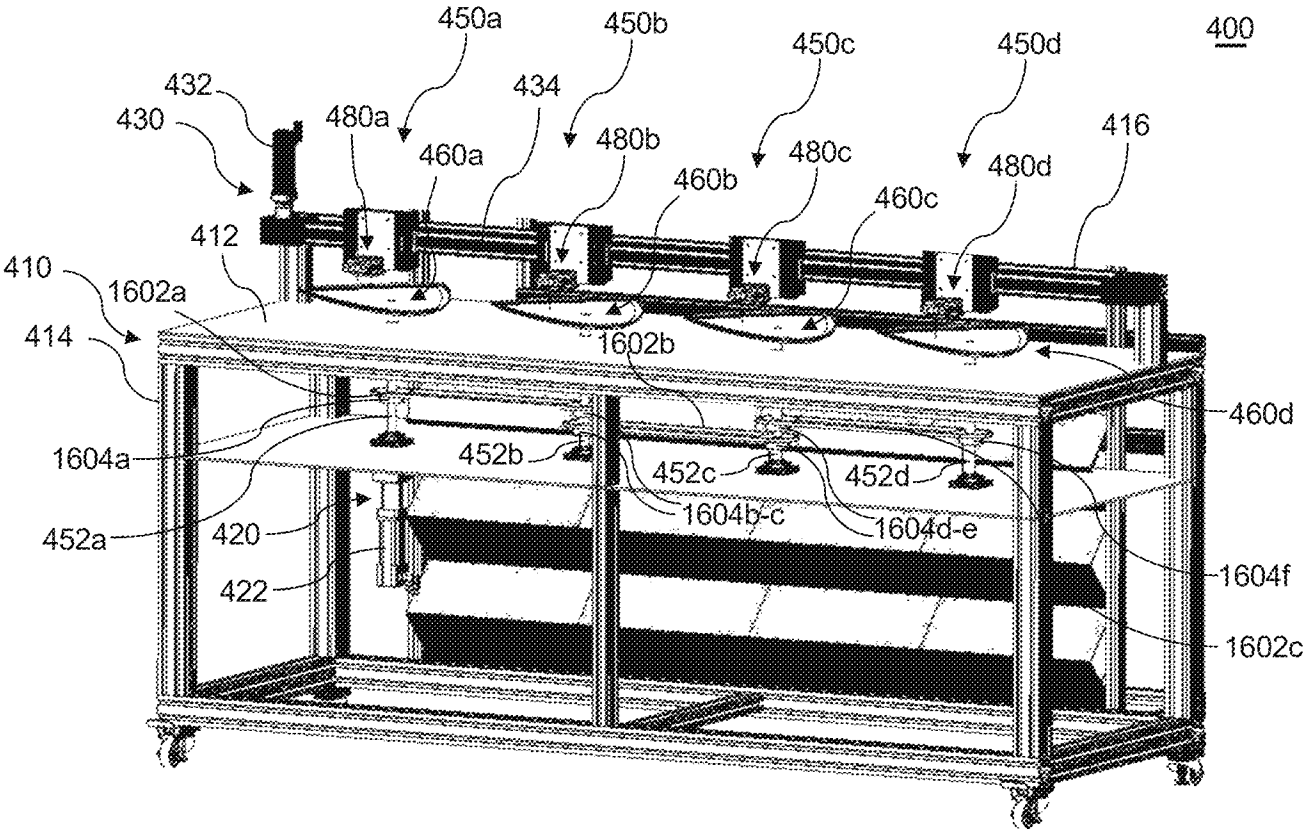
FIG. 16 shows an apparatus for producing thread layers according to some embodiments.

FIG. 16 illustrates a winding apparatus 400 according to some embodiments. In some embodiments, winding apparatus 400 can comprise a plurality of winding units 450. For example, winding apparatus 400 can comprise a first winding unit 450*a*, a second winding unit 450*b*, a third winding unit 450*c*, and a fourth winding unit 450*d*. Each of first, second, third, and fourth winding units 450*a-d* can comprise all or a subset of the components described above with respect to FIG. 4. While FIG. 16 shows four winding units 450 supported by frame 410, frame 410 can support fewer or more winding units 450, such as one, two, three, five, six, seven, eight, nine, or ten winding units 450.

As shown in FIG. 16, in some embodiments, first actuator 420 can be operationally coupled to each of plates 460*a-d* (for example, via each of shafts 452*a-d*). For example, a single torque generating element (for example, motor 422) that is mechanically coupled to shaft 452*a* can be mechanically coupled (in some cases via shaft 452*a*) to shaft 452*b*, shaft 452*c*, and/or shaft 452*d*. In some embodiments, motor 422 can be coupled via one or more belts, chains, racks, or cables to shaft 452 of each of winding units 450. Activation of the motor can rotate all of shafts 452*a-d* and plates 460*a-d*. In some embodiments, activation of the motor can turn all of shafts 452*a-d* at substantially the same rotation rate and in the same rotation direction. In some embodiments, due to varying the size and/or number of gears, sheaves, or pulleys comprised by first actuator 420, activation of motor 422 can turn shafts 452*a-d* at different rotation rates and/or in different directions.

In such embodiments, first actuator 420 can comprise flexible couplings 1602*a-c* and wheels 1604*a-f*. In some embodiments, flexible couplings 1602*a-c* can be belts, chains, racks, or cables. In some embodiments, wheels 1604*a-f* can be gears, sheaves, or pulleys. As shown in FIG. 16, a wheel 1604*a* can be coupled to shaft 452*a* and flexible coupling 1602*a* can engage with wheel 1604*a*. Flexible coupling 1602*a* can also engage with a wheel 1604*b* coupled to shaft 452*b*. Flexible coupling 1602*a* can transfer rotation of shaft 452*a*/wheel 1604*a* to wheel 1604*b*/shaft 452*b* such that shaft 452*b* rotates simultaneously with shaft 452*a*. Likewise, a wheel 1604*c* can be coupled to shaft 452*b* and a flexible coupling 1602*b* can engage with wheel 1604*c*. Flexible coupling 1602*b* can also engage with a wheel 1604*d* coupled to shaft 452*c*. Flexible coupling 1602*b* can transfer rotation of shaft 452*b*/wheel 1604*c* to wheel 1604*d*/shaft 452*c* such that shaft 452*c* rotates simultaneously with shaft 452*b*. Finally, a wheel 1604*e* can be coupled to shaft 452*c* and a flexible coupling 1602*c* can engage with wheel 1604*e*. Flexible coupling 1602*c* can also engage with a wheel 1604*f* coupled to shaft 452*d*. Flexible coupling 1602*c* can transfer rotation of shaft 452*c*/wheel 1604*e* to wheel 1604*f*/shaft 452*d* such that shaft 452*d* rotates simultaneously with shaft 452*c*. Accordingly, activation of motor 422 can rotate all of shafts 452*a-d* and plates 460*a-d*.

While FIG. 16 shows shafts 452*a-d* successively coupled (for example, shaft 452*a* is coupled to shaft 452*b*, which is then coupled to shaft 452*c*) to transfer rotation of motor 422 to each of shafts 452*a-d*, in some embodiments, each of shafts 452*a-d* can be coupled via a single rotation transferring element (for example, a belt, chain, rack, or cable) to motor 422. The single rotation transferring element can be coupled to all of shafts 452*a-d*, or each shaft 452*a-d* can be coupled to motor 422 via a separate single rotation transferring element.

In some embodiments, second actuator 430 can be operationally coupled to each of thread guides 480*a-d*. For example, a single translation generating element, for example, a component of an electromechanical linear actuator, a hydraulic linear actuator, or a pneumatic linear actuator that is mechanically coupled to thread guide 480*a* be mechanically coupled to thread guide 480*b*, thread guide 480*c*, and/or thread guide 480*d*. For example, a single motor (for example, motor 432) within an electromechanical linear actuator can be coupled via one or more belts, chains, racks, or cables to thread guide 480 (for example, using coupling 470) of each of winding units 450, or via any other elements for producing linear motion from rotational motion.

In some embodiments, second actuator 430 can comprise a flexible coupling 434 (for example, a belt, chain, rack, or cable) to which each of thread guides 480*a-d* is attached (for example, via couplings 470). In some embodiments, activation of the single translation generating element can move all of thread guides 480*a-d* at substantially the same rate and in the same direction. In some embodiments, due to varying the size and/or number of belts, chains, racks, or cables and gears, sheaves, or pulleys within second actuator 430, activation of the translation generating element can move thread guides 480*a-d* at different rates and/or in different directions.

In some embodiments, first actuator 420 and/or second actuator 430 being operationally coupled to a plurality of plates 460 and a plurality of thread guides 480, respectively, can reduce the complexity of programming required to control winding apparatus 400. For example, a single set of instructions can be provided to a control system that determines winding patterns for all of winding units 450 during production of thread layers or thread patterns. Furthermore, in some embodiments, first actuator 420 and/or second actuator 430 being operationally coupled to a plurality of plates 460 and a plurality of thread guides 480, respectively, can reduce the mechanical cost and complexity of winding apparatus 400, requiring fewer components. Additionally, first actuator 420 and/or second actuator 430 being operationally coupled to a plurality of plates 460 and a plurality of thread guides 480, respectively, can make winding apparatus 400 more energy efficient, since winding apparatus 400 can comprise fewer energy-consuming components (for example, motors).

While the above discussion focuses on embodiments in which first actuator 420 and/or second actuator 430 are operationally coupled to a plurality of plates 460 and a plurality of thread guides 480, respectively, in some embodiments, winding apparatus 400 can comprise a plurality of first actuators 420 and/or a plurality of second actuators 430 each operationally coupled to a separate plate 460 and thread guide 480, respectively. In some embodiments, each of the plurality of first actuators 420 can be operationally coupled to a plate 460 via a shaft 452 of a winding unit 450. In some embodiments, each of the plurality of second actuators 430 can be operationally coupled to a thread guide 480 of a winding unit 450. In such embodiments, the plurality of first actuators 420 can be independently controllable and the plurality of second actuators 430 can be independently controllable. In such embodiments, a set of instructions can be provided to a control system or control systems for each of winding units 450 of winding apparatus 400. The sets of instructions can determine winding patterns for each of winding units 450 during production of a thread layer or thread pattern. Such embodiments can provide for increased customization of materials wound using winding apparatus 400. For example, wound materials with different characteristics and properties can be produced using the same winding apparatus 400.

In some embodiments in which a plurality of first actuators 420 and/or a plurality of second actuators 430 are each operationally coupled to a separate plate 460 and a separate thread guide 480, respectively, each of first actuators 420 can be controlled by separate control systems and each of second actuators 430 can be controlled by separate control systems (while a pair of a first actuator 420 and a second actuator 430 controlling the same winding unit 450 can be controlled by the same control system). In some embodiments in which a plurality of first actuators 420 and/or a plurality of second actuators 430 are each operationally coupled to a separate plate 460 and a separate thread guide 480, respectively, all of first actuators 420 and second actuators 430 can be controlled by a single control system. In either case, the control system(s) can comprise an interface (for example, display interface 1102) that a user can interact with to provide instructions to the control system(s).

Figure 17:
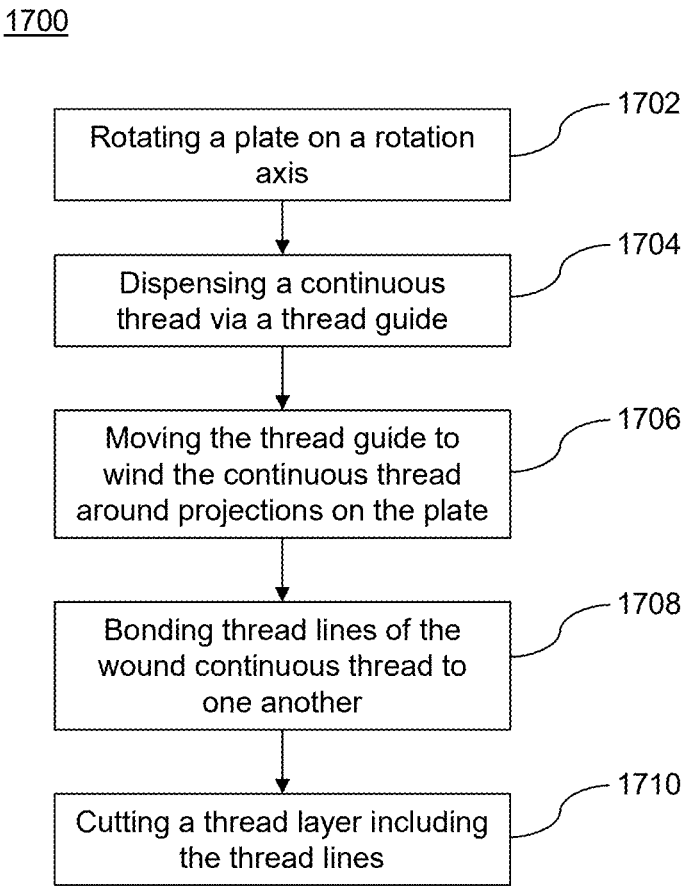
FIG. 17 is an exemplary flowchart for methods according to some embodiments.

FIG. 17 shows a method 1700 of making an article of apparel (for example, article of apparel 100) according to some embodiments.

Unless stated otherwise, the steps of method 1700 need not be performed in the order set forth herein. Additionally, unless specified otherwise, the steps of method 1700 need not be performed sequentially. The steps can be performed in a different order or simultaneously. As one example, step 1704 of method 1700 need not be performed before step 1706. Rather, step 1704 can be performed simultaneously with step 1706. As another example, step 1706 need not be performed after step 1702. Rather, step 1706 can be performed simultaneously with, before, or after step 1702. Further, method 1700 may not comprise all the steps illustrated. For example, method 1700 may not comprise 1710.

Step 1702 can comprise rotating a plate (for example, plate 460) on a rotation axis (for example, axis A). In some embodiments, the plate can comprise a base (for example, base 462) and a plurality of projections (for example, two or more anchor points 464, which can be projections) extending from the base. In some embodiments, the plate can be rotated on the rotation axis by a shaft (for example, shaft 452) coupled to the base. In some embodiments, step 1702 can comprise changing at least one of a rotation rate or a rotation direction of the plate. In some embodiments, step 1702 can comprise changing at least one of the rotation rate or the rotation direction of the plate while moving a thread guide (for example, in a "simultaneous" or "partially consecutive" modes as described above) or while the thread guide is stationary (for example, in "consecutive" or "partially consecutive" modes as describe above).

In some embodiments, method 1700 can additionally or alternatively comprise changing at least one of a translation rate or a translation direction of the thread guide while rotating the plate or while the plate is stationary. In some embodiments, changing the translation rate and/or translation direction can change a winding pattern for a thread layer. In some embodiments, method 1700 can comprise changing one or more of the rotation rate, rotation direction, translation rate, or translation direction while keeping one or more of the rotation rate, rotation direction, translation rate, or translation direction constant.

Step 1704 can comprise dispensing a continuous thread (for example, continuous thread 600) via a thread guide (for example, thread guide 480). In some embodiments, the thread guide can be movable laterally along a lateral axis (for example, thread guide translation axis C). In some embodiments, the lateral axis can pass over the shaft. In some embodiments, the continuous thread can be fixed to the plate (for example, at an anchor point 464) prior to dispensing the continuous thread and winding the continuous thread around further anchor points 464.

Step 1706 can comprise moving the thread guide to wind the continuous thread around projections on the plate (for example, around the plurality of projections). In some embodiments, moving the thread guide can comprise moving the thread guide along the lateral axis and between respective projections of the plurality of projections. In some embodiments, moving the thread guide can comprise moving the thread guide only along a single axis during winding of the continuous thread. In some embodiments, moving the thread guide can comprise moving the thread guide while rotating the plate (for example, in "simultaneous" or "partially consecutive" modes as described above). In some embodiments, moving the thread guide can comprise moving the thread guide while the plate is stationary (for example, in "consecutive" or "partially consecutive" modes as describe above). In some embodiments, only translation of the thread guide along the lateral axis and rotation of the plate on the rotation axis are required to wind the continuous thread around the plurality of projections. In some embodiments, a length of the continuous thread wound around the plurality of projections is greater than a distance traveled by the thread guide during winding of the length of the continuous thread, as described above with respect to FIGS. 7A-15.

As described herein, winding the continuous thread around the plurality of projections in step 1706 can form a thread layer (for example, thread layer 120, 130, 140, 310, 320, or 330) comprising a plurality of thread lines (for example, thread lines 204, 224, or 244), with each thread line extending between two respective projections of the plurality of projections and across the plate.

In some embodiments, step 1706 can comprise winding multiple thread layers. In such embodiments, method 1700 can comprise winding a second continuous thread around the plurality of projections to form a second thread layer comprising a second plurality of thread lines, with each thread line of the second plurality of thread lines extending between two respective projections of the plurality of projections and across the plate.

Step 1708 can comprise bonding thread lines of the wound continuous thread (for example, thread lines of the plurality of thread lines) to one another. In some embodiments, step 1708 can comprise bonding the thread lines of the plurality of thread lines to one another while the thread layer is on the plate.

In some embodiments, the thread lines can be bonded within the thread layer or a thread pattern (for example, thread pattern 300). In some embodiments, continuous thread(s) can be bonded at points of intersection between thread lines via, for example, an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). In some embodiments, continuous thread(s) can be directly bonded at points of intersection between thread lines.

In some embodiments, continuous thread(s) can be bonded at the projections via, for example, an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). In some embodiments, continuous thread(s) can be directly bonded at the projections.

In some embodiments, a heat press can provide heat at a predetermined temperature equal to or above the melting point of polymeric material(s) of polymer thread(s) of a thread layer or thread pattern. In some embodiments, the heat press can provide heat at a predetermined temperature below the melting point of polymeric material(s) of polymer thread(s) of a thread layer or thread pattern, but high enough to cause the polymeric material(s) to bond (fuse) together, or to other materials of the thread layer or thread pattern.

Heat can be applied to a thread layer or thread pattern in one or more ways, such as but not limited to, radio frequency heat sealing (welding), high frequency heat sealing (welding), infrared welding, and steaming.

In some embodiments, bonding can be facilitated by steps 1702-1706 comprising winding a bonding continuous thread. The bonding continuous thread can be configured to attach to other continuous threads within a thread layer or thread pattern according to any of the methods described herein. In some embodiments, the bonding continuous thread can comprise a material, for example, a polymeric material as described herein, that can be softened via heat or other treatment to attach to other continuous threads within a thread layer or thread pattern. In some embodiments, the bonding continuous thread can be wound simultaneously with the continuous thread through the same thread guide 480. In such embodiments, the bonding continuous thread can remain separate from the continuous thread, while in some embodiments, the bonding continuous thread and the continuous thread can be plied together into a multi-filament thread that is wound as a single thread. In some embodiments, the continuous thread can be wound into a thread layer and a second thread layer comprising the bonding continuous thread can be wound on top of the thread layer comprising the continuous thread, or vice-versa.

In some embodiments, method 1700 can comprise multiple winding steps 1706 and multiple bonding steps 1708. For example, a portion of a thread pattern can be wound in a first winding step 1706 and then that portion can be bonded in a first bonding step 1708. Then a second portion of a thread pattern can be wound in a second winding step 1706 and that portion can be bonded in a second bonding step 1708. In some embodiments, bonding step 1708 can comprise a preliminary bonding step to hold the pattern of a thread layer or thread pattern until a final bonding step is performed. For example, a preliminary bonding step can allow a thread layer or thread pattern to be removed from anchor points and be finally bonded after removal.

Step 1710 can comprise cutting the thread layer. In some embodiments, step 1710 can comprise cutting the thread layer while the thread layer is on the plate. In some embodiments, the thread layer can be cut adjacent the projections. In some embodiments, cutting in step 1710 can define all or a portion of a thread border (for example, thread border 250) for a thread layer or thread pattern.

In some embodiments, the material produced using all or a subset of steps 1702-1710 can be added to or shaped into an article of apparel (for example, article of apparel 100). In some embodiments, shaping the material can comprise joining the material to itself at a seam. In some embodiments, adding the material produced using steps 1702-1710 to the article of apparel can comprise attaching the material to one or more additional pieces of material to form the article of apparel. In some embodiments, attaching the material to the one or more additional pieces of material can comprise seaming the material to one or more of the additional pieces of material at one or more seams. In some embodiments, the one or more of the additional pieces of material can be made using method 1700. In some embodiments, the one or more of the additional pieces of material can be a piece of material without a thread layer or thread pattern as described herein.

Figure 18:
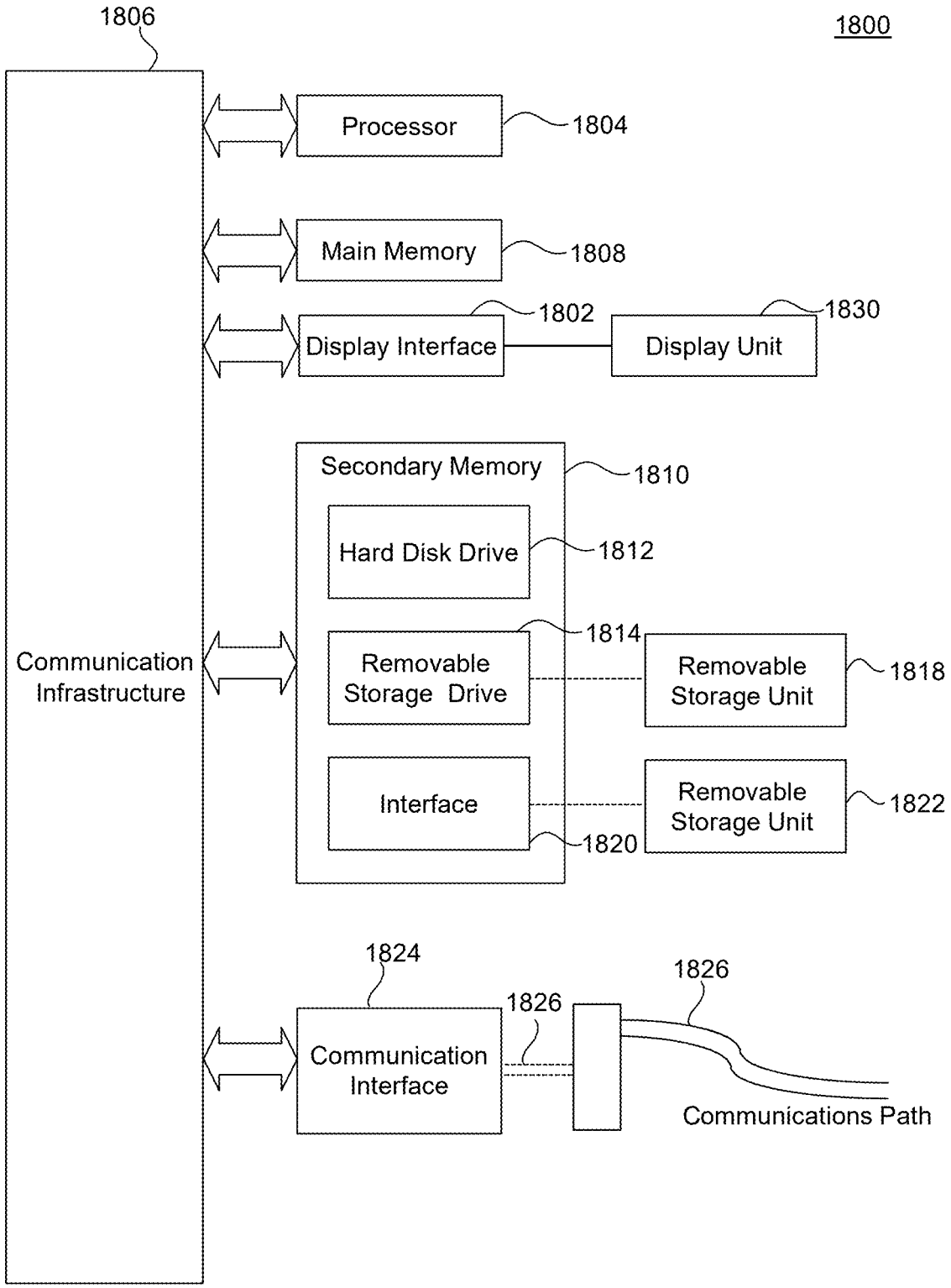
FIG. 18 shows a schematic block diagram of an exemplary computer system with which embodiments can be implemented.

FIG. 18 shows an exemplary computer system 1800 by which embodiments, or portions thereof, can be implemented as computer-readable code, according to some embodiments. For example, aspects of the methods discussed herein can be implemented by computer system 1800 using hardware, software, firmware, tangible computer readable media having instructions stored thereon, or a combination thereof and can be implemented by one or more computer systems or other processing systems.

If programmable logic is used, such logic can execute on a commercially available processing platform or a special purpose device. One of ordinary skill in the art can appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that can be embedded into virtually any device.

For instance, at least one processor device and a memory can be used to implement the above-described embodiments. A processor device can be a single processor, a plurality of processors, or combinations thereof. Processor devices can have one or more processor "cores."

Various embodiments described herein can be implemented in terms of this example computer system 1800. After reading this description, it will become apparent to a person skilled in the relevant art how to implement one or more of the embodiments using other computer systems and/or computer architectures. Although operations can be described as a sequential process, some of the operations can in fact be performed in parallel, concurrently, and/or in a distributed environment, and with program code stored locally or remotely for access by single or multi-processor machines. In addition, in some embodiments the order of operations can be rearranged without departing from the spirit of the disclosed subject matter.

Processor device 1804 can be a special purpose or a general-purpose processor device. As will be appreciated by persons skilled in the relevant art, processor device 1804 can also be a single processor in a multi-core/multiprocessor system, such system operating alone, or in a cluster of computing devices operating in a cluster or server farm. Processor device 1804 is connected to a communication infrastructure 1806, for example, a bus, message queue, network, or multi-core message-passing scheme.

Computer system 1800 also comprises a main memory 1808, for example, random access memory (RAM), and can also comprise a secondary memory 1810. Secondary memory 1810 can comprise, for example, a hard disk drive 1812, or removable storage drive 1814. Removable storage drive 1814 can comprise a floppy disk drive, a magnetic tape drive, an optical disk drive, a flash memory, a Universal Serial Bus (USB) drive, or the like. The removable storage drive 1814 reads from and/or writes to a removable storage unit 1818 in a well-known manner. Removable storage unit 1818 can comprise a floppy disk, magnetic tape, optical disk, etc. which is read by and written to by removable storage drive 1814. As will be appreciated by persons skilled in the relevant art, removable storage unit 1818 comprises a computer usable storage medium having stored therein computer software and/or data.

Computer system 1800 (optionally) comprises a display interface 1802 (which can comprise input and output devices such as keyboards, mice, etc.) that forwards graphics, text, and other data from communication infrastructure 1806 (or from a frame buffer not shown) for display on display unit 1830.

In additional and/or alternative implementations, secondary memory 1810 can comprise other similar means for allowing computer programs or other instructions to be loaded into computer system 1800. Such means can comprise, for example, a removable storage unit 1822 and an interface 1820. Examples of such means can comprise a program cartridge and cartridge interface (such as that found in video game devices), a removable memory chip (such as an EPROM, or PROM) and associated socket, and other removable storage units 1822 and interfaces 1820 which allow software and data to be transferred from the removable storage unit 1822 to computer system 1800.

Computer system 1800 can also comprise a communication interface 1824. Communication interface 1824 allows software and data to be transferred between computer system 1800 and external devices. Communication interface 1824 can comprise a modem, a network interface (such as an Ethernet card), a communication port, a PCMCIA slot and card, or the like. Software and data transferred via communication interface 1824 can be in the form of signals, which can be electronic, electromagnetic, optical, or other signals capable of being received by communication interface 1824. These signals can be provided to communication interface 1824 via a communication path 1826. Communication path 1826 carries signals and can be implemented using wire or cable, fiber optics, a phone line, a cellular phone link, an RF link or other communication channels.

In this document, the terms "computer program medium" and "computer usable medium" are used to generally refer to media such as removable storage unit 1818, removable storage unit 1822, and a hard disk installed in hard disk drive 1812. Computer program medium and computer usable medium can also refer to memories, such as main memory 1808 and secondary memory 1810, which can be memory semiconductors (for example, DRAMs, etc.).

Computer programs (also called computer control logic) are stored in main memory 1808 and/or secondary memory 1810. Computer programs can also be received via communication interface 1824. Such computer programs, when executed, enable computer system 1800 to implement the embodiments as discussed herein. In particular, the computer programs, when executed, enable processor device 1804 to implement the processes of the embodiments discussed here. Accordingly, such computer programs represent controllers of the computer system 1800. Where the embodiments are implemented using software, the software can be stored in a computer program product and loaded into computer system 1800 using removable storage drive 1814, interface 1820, and hard disk drive 1812, or communication interface 1824.

Embodiments described herein also can be directed to computer program products comprising software stored on any computer useable medium. Such software, when executed in one or more data processing device, causes a data processing device(s) to operate as described herein. Embodiments described herein can employ any computer useable or readable medium. Examples of computer useable mediums comprise, but are not limited to, primary storage devices (for example, any type of random access memory), secondary storage devices (for example, hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A winding apparatus for manufacturing an article of apparel, the winding apparatus comprising:

a winding unit, comprising:

a rotatable shaft, a thread guide, the thread guide movable along an axis perpendicular to the shaft, and a plate, the plate comprising a base coupled to the shaft and a plurality of projections extending from the base;

a first actuator configured to rotate the shaft; and a second actuator configured to move the thread guide along the axis and between respective projections of the plurality of projections.

2. The winding apparatus of claim 1, wherein the thread guide is movable along the axis between points that lie outside a perimeter of the plate regardless of an orientation of the plate.

3. The winding apparatus of claim 1, wherein the base is coupled to the shaft adjacent a center of mass of the plate.

4. The winding apparatus of claim 1, wherein the axis passes over the shaft.

5. The winding apparatus of claim 1, wherein a minimum diameter of the base is greater than or equal to half of a maximum diameter of the base.

6. The winding apparatus of claim 1, wherein each projection of the plurality of projections extends from the base at an angle from 90 to 175 degrees.

7. The winding apparatus of claim 1, comprising a plurality of winding units, wherein the shaft of each of the plurality of winding units is operationally coupled to the first actuator and the thread guide of each of the plurality of winding units is operationally coupled to the second actuator.

8. The winding apparatus of claim 1, comprising:

a plurality of winding units;

a plurality of first actuators each operationally coupled to the shaft of a winding unit of the plurality of winding units; and a plurality of second actuators each operationally coupled to the thread guide of a winding unit of the plurality of winding units, wherein the plurality of first actuators are independently controllable and the plurality of second actuators are independently controllable.

9. The winding apparatus of claim 1, wherein the thread guide is slidably coupled to a bar.

* * * * *